US006236554B1

(12) United States Patent
Groppo et al.

(10) Patent No.: US 6,236,554 B1
(45) Date of Patent: May 22, 2001

(54) ELECTROACTUATOR CONTROL DEVICE AND METHOD FOR CONTROLLING THIS CONTROL DEVICE

(75) Inventors: Riccardo Groppo, Roletto; Giancarlo Casellato, Turin; Alberto Manzone, Alba; Alessandro Pincetti, Castiglione Torinese, all of (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 09/216,475

(22) Filed: Dec. 18, 1998

(30) Foreign Application Priority Data

Dec. 19, 1997 (IT) ..... T097A1115

(51) Int. Cl.[7] ..... H01H 47/00
(52) U.S. Cl. ..... 361/191; 361/160; 361/155
(58) Field of Search ..... 361/160, 115, 361/155, 191

(56) References Cited

U.S. PATENT DOCUMENTS

| | | | |
|---|---|---|---|
| 1,574,520 | 2/1926 | Singer . | |
| 2,367,008 | 1/1945 | Davidson . | |
| 2,774,529 | 12/1956 | Abrams et al. . | |
| 4,112,477 | 9/1978 | Sherwin | 361/155 |
| 4,576,135 | 3/1986 | Johnson | 123/490 |

FOREIGN PATENT DOCUMENTS

| | | | |
|---|---|---|---|
| 484014 | 7/1975 | (AU) | B31B/5/00 |
| 4413240 | 10/1995 | (DE) | H01F/7/18 |
| 1953071 | 9/1996 | (DE) | H01F/7/18 |
| 19539071 | 9/1996 | (DE) | H01F/7/18 |
| 0737806 | 10/1996 | (EP) | F02D/41/20 |
| 1285801 | 8/1972 | (GB) | B65B/11/16 |
| 9704230 | 2/1997 | (WO) | F02D/41/20 |

*Primary Examiner*—Stephen W. Jackson
(74) *Attorney, Agent, or Firm*—Frost Brown Todd LLC

(57) ABSTRACT

The control device comprises a piloting circuit for the electroactuators and a timing circuit which generates timing signals supplied to the piloting circuit for control of the electroactuators. The piloting circuit has a first and a second input terminal which are connected in use respectively to a first and a second terminal of an electrical energy source, and a plurality of pairs of output terminals, one for each electroactuator; each pair of output terminals comprising a first and a second output terminal, between which a respective electroactuator is connected in use. The piloting circuit comprises a plurality of control circuits, one for each electroactuator, which receive as input the timing signals and are activated selectively by the timing signals themselves. Each control circuit comprises a first transistor which is connected between a respective first output terminal, and, at least in pre-determined operating conditions, the first input terminal of the piloting circuit; a second transistor connected between a respective second output terminal and the second input terminal of the piloting circuit; and a diode which is connected between the respective first output terminal and the second input terminal of the piloting circuit itself.

82 Claims, 13 Drawing Sheets

T3 t
t0
t1
T1 t
t0
tONH
tOFFH
tBYPASS
tONL
tOFFL
t HOLD
T2 t
t0
t2
IL
I2
ITH1
I1≈I3

I5
ITH2
I4≈I6
t
t0
tONH
tOFF H
tP
t1
tBY PASS
tONL
tOFFL
t2
t HOLD
t3

ELECTROACTUATOR CONTROL DEVICE AND METHOD FOR CONTROLLING THIS CONTROL DEVICE

BACKGROUND OF THE INVENTION

The present invention relates to an electroactuator control device and to a method for controlling this control device.

The control device according to the present invention can be used advantageously, but need not be used exclusively, to control electroinjectors of an injection system for an internal combustion engine of the petrol, diesel, methane or LPG-operated type, to which the following description will make specific reference, without however detracting from general applicability.

In fact the control device according to the present invention can also be applied to any other type of electroactuator, such as solenoid valves of ABS devices and the like, and solenoid valves of variable phasing systems etc.

As is known, in order to control the electroinjectors of an injection system of an internal combustion engine, it is necessary to supply to each electroinjector a current, the development of which over a period of time comprises a section of fast increase, a section of slower increase, a section of decrease to a maintenance value, a section of oscillating amplitude around the maintenance value, and a section of decrease to a value of approximately zero.

In order to obtain this development over a period of time, at present control devices are used in which the electroinjectors are connected on the one hand to a low voltage supply source, and on the other hand to an earthing line, by means of a controlled electronic switch.

These control devices have the disadvantage that any short-circuit to earth of one of the terminals of any of the electroinjectors, caused for example by a loss of insulation in a wiring conductor of the electroinjectors themselves, and by the contact of this conductor with the vehicle bodywork, would damage definitively the electroinjector itself and/or the control device, thus making the vehicle stall, which is a decidedly dangerous situation when the vehicle is running.

In order to avoid this dangerous disadvantage, control devices for electroinjectors have been proposed which are connected on the one hand to earth, and on the other hand to an internal node of the control devices themselves, such that any short-circuit to earth of one of the terminals of the electroinjectors does not give rise to damage to the control device, and thus to stalling of the vehicle, but simply puts that individual electroinjector out of use, so that the vehicle can continue to run with one electroinjector short.

However these control devices have the disadvantage that their circuitry is complicated, they are costly, and also in general they do not make it possible to carry out simultaneous injections into different cylinders, which would however be necessary for example in cases in which control of injection of the engine requires multiple injections into each cylinder.

SUMMARY OF THE INVENTION

The object of the present invention is to produce an electroactuator control device which is simple, economical, and makes it possible to eliminate the above-described disadvantages.

According to the present invention, an electroactuator control device is provided, as described in claim 1.

The present invention also relates to a method for controlling this control device, as described in claim 23.

BRIEF DESCRIPTION OF THE DRAWINGS

In order to assist understanding of the present invention, a preferred embodiment is now described, purely by way of non-limiting example, and with reference to the attached drawings, in which.

DETAILED DESCRIPTION OF THE INVENTION

Figure 1:
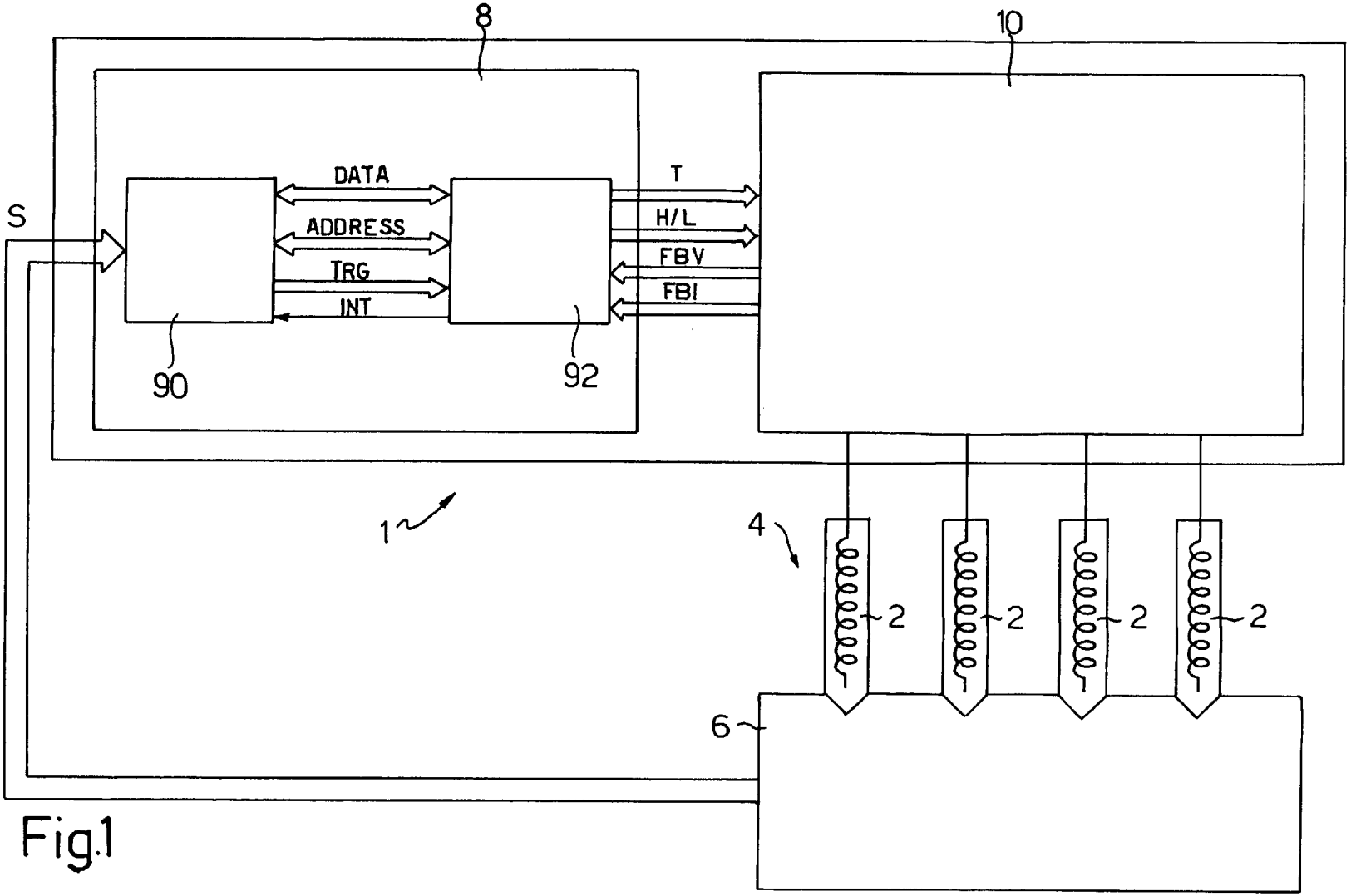
FIG. 1 is a block diagram of an injection system of an internal combustion engine comprising a control device according to the present invention.

In FIG. 1, 1 indicates as a whole a control device for electroinjectors 2 of an injection system 4 of an internal combustion engine 6 of a vehicle (not shown). In particular, the electroinjectors 2 are illustrated by means of electrical equivalents consisting of inductors.

The control device 1 comprises a timing circuit 8 which receives as input data signals S which are measured on the engine 6, in particular speed and angular position of the engine 6 and injection advance, and which generates as output timing signals T and state signals H/L which are used to control the electroinjectors 2; it also comprises a piloting circuit 10 which receives as input the timing signals T and the state signals H/L, and has the function of piloting the electroinjectors 2 on the basis of the timing signals T and of the state signals H/L, as well as of generating reaction signals FBI, FBV1 and FBV2 for the timing circuit 8, in the manner described in greater detail hereinafter.

Figure 2:
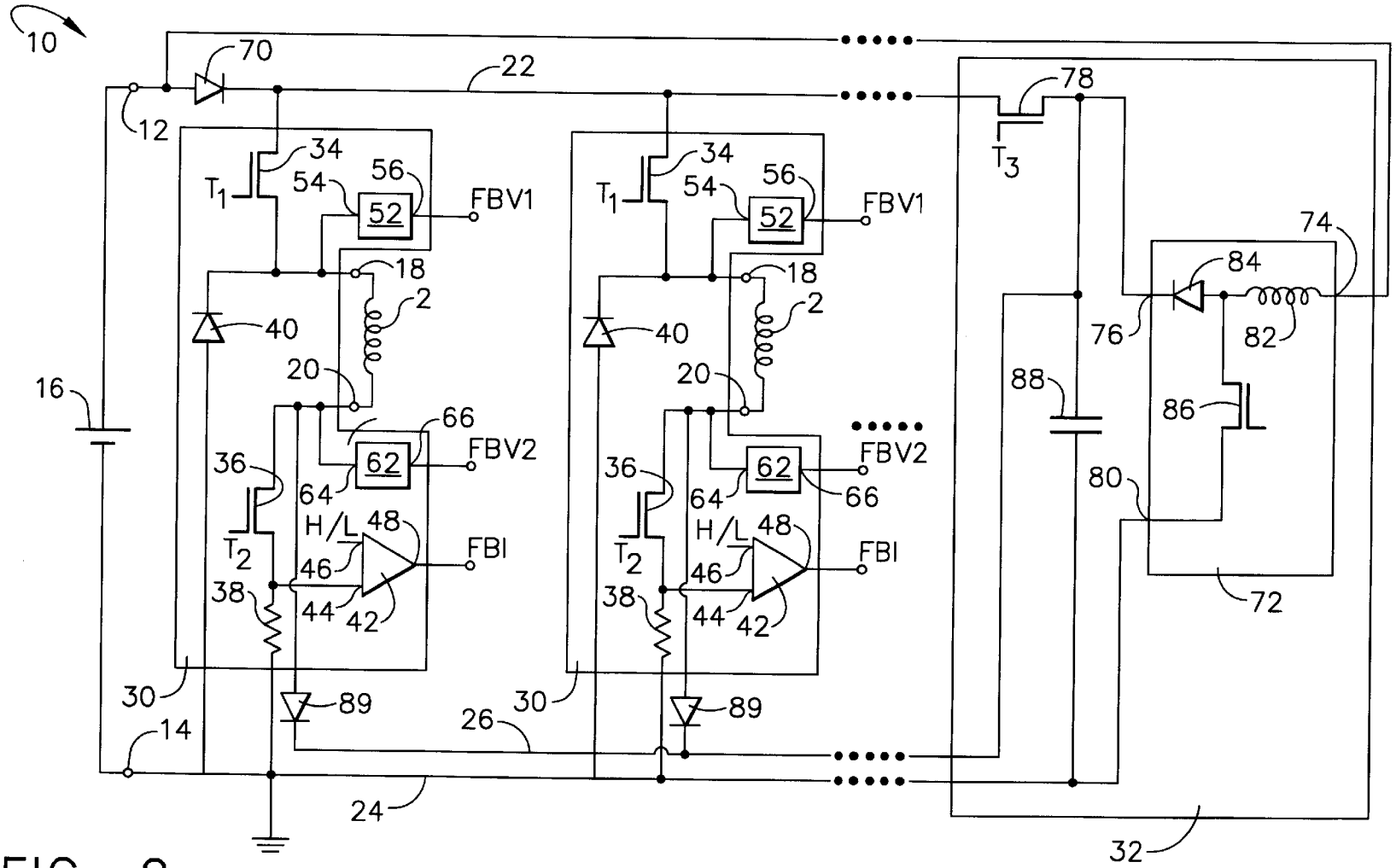
FIG. 2 is a circuit diagram of the control device in FIG. 1.

As shown in FIG. 2, the piloting circuit 10 comprises a first and a second input terminal 12, 14, which can be connected respectively to a positive pole and a negative pole of an electrical energy source 16, for example a battery of the vehicle, and a plurality of pairs of output terminals, one for each electroinjector 2, each of which comprises a first and a second output terminal 18, 20, between which a respective electroinjector 2 is connected in use.

The piloting circuit 10 additionally comprises a supply line 22, which is connected in the manner described in greater detail hereinafter to the first input terminal 12; an earthing line 24 which is directly connected to the second input terminal 14 and to the electrical earth of the vehicle; and an internal connection line 26.

The piloting circuit 10 additionally comprises a plurality of circuits 30 for controlling the electroinjectors 2, one for each electroinjector 2, connected to the supply and earthing lines 22, 24 and to the timing circuit 8, and each interposed between the first and the second input terminal 12, 14 and a respective pair of output terminals 18, 20, which receive as input the timing signals T and the state signals H/L, and are activated selectively by the timing signals T themselves in order to control the respective electroactuators 2.

The piloting circuit 10 additionally comprises a voltage-increasing circuit 32 which is common to the control circuits 30, and is connected to the supply and earthing lines 22, 24, and, via the connection line 26, to the control circuits 30, with the purpose of supplying a higher voltage than the voltage supplied by the electrical energy source 16, in order, in the initial control step of the electroactuators 2, to permit generation of a current which increases substantially linearly, with a slope which is greater than the slope which can be obtained by means of the voltage supplied by the electrical energy source 16, and co-operating with the control circuit 30 which in each case is activated in order to supply the corresponding electroinjector 2.

Each control circuit 30 comprises a first piloting transistor 34 of the MOSFET type, which has a control terminal connected to the timing circuit 8, and receives from the latter a first timing signal $T_1$, a sink terminal which is connected to the supply line 22, and a source terminal which is connected to the first output terminal 18; and a second piloting transistor 36 of the MOSFET type, which has a control terminal connected to the timing circuit 8, and receives from the latter a second timing signal $T_2$, a sink terminal which is connected to the second output terminal 20, and a source terminal which is connected to the earthing line 24 by means of a shunt resistor 38.

Each control circuit 30 also comprises a discharge diode 40, the anode of which is connected to the earthing line 24, and the cathode of which is connected to the first output terminal 18.

Each control circuit 30 also comprises a comparator circuit 42, which has a first input terminal 44 connected to the source terminal of the second piloting transistor 36, i.e. which is connected to a terminal of the shunt resistor 38, a second input terminal 46 which is connected to the timing circuit 8 and receives from the latter a state signal H/L, and an output terminal 48 to which it supplies a first reaction signal FBI which is supplied to the timing circuit 8 itself.

The state signal H/L is a digital-type voltage signal, and assumes a high logic level which is defined by a first voltage value, for example 5 volts, and a low logic level which is defined by a second voltage value which is lower than the first, for example 0 volt. The state signal H/L switches from the high logic level to the low logic level during control of the corresponding electroinjector 2, in the manner described in greater detail hereinafter.

The comparator circuit 42 has the purpose of comparing the voltage of the source terminal of the piloting transistor 36, relative to the voltage of the earthing line 24, with the voltage value assumed by the state signal H/L, in order to generate the first reaction signal FBI according to the result of the comparison.

In detail, the first reaction signal FBI is a digitaltype voltage signal which indicates whether or not current is passing in the corresponding electroinjector 2, and assumes a first logic level, for example the high logic level, when the voltage at the ends of the shunt resistor 38 is greater than the voltage value assumed by the first state signal H/L (i.e. when current is passing in the corresponding electroinjector 2), and it assumes a second logic level, the low logic level in the example in question, when the voltage at the ends of the shunt resistor 38 is the same as, or lower than the voltage value assumed by the first state signal H/L (i.e. when current is not passing in the corresponding electroinjector 2).

The first reaction signal FBI is used by the timing circuit 8 in order to carry out a closed-loop check on the current which is flowing in the corresponding electroinjector 2, in the manner described in detail hereinafter.

Each control circuit 30 additionally comprises a first voltage-limiting circuit 52 which has an input terminal 54 which is connected to the source terminal of the first piloting transistor 34, i.e. which is connected to the first output terminal 18 of the control circuit 30 itself, and an output terminal 56 to which it supplies a second reaction signal FBV1, which is supplied to the timing circuit 8.

The first voltage-limiting circuit 52 has the purpose of supplying to the output terminal 56 a second reaction signal FBV1, which is obtained by limiting the dynamics of the voltage of the source terminal of the first piloting transistor 34, which is typically variable between 0 and 12 volts. In particular, the second reaction signal FBV1 is a voltage signal substantially of the digital type, which is indicative of the voltage value assumed by the so-called "hot side" of the corresponding electroinjector 2, and assumes a high logic level which is defined by the first voltage value, for example 5 volts, when the hot side of the corresponding electroinjector 2 is set to a voltage which is close to the voltage of the positive pole of the electrical energy source 16, and it assumes a low logic value which is defined by a second voltage value lower than the first, for example 0 volt, when the hot side of the corresponding electroinjector 2 is set to a voltage which is close to the voltage of the negative pole of the electrical energy source 16 (earthing voltage).

Each control circuit 30 additionally comprises a second voltage-limiting circuit 62 which has an input terminal 64 connected to the sink terminal of the second piloting transistor 36, i.e. which is connected to the second output terminal 18 of the control circuit 30 itself, and an output terminal 66 to which it supplies a third reaction signal FBV2 which is supplied to the timing circuit 8.

The second voltage-limiting circuit 62 has the purpose of supplying to the output terminal 66 a third reaction signal FBV2 which is obtained by limiting the dynamics of the voltage of the sink terminal of the second piloting transistor 36, which is typically variable between 0 and 12 volts. In particular, the third reaction signal FBV2 is a voltage signal substantially of the digital type, which is indicative of the voltage value present at the so-called "cold side" of the corresponding electroinjector 2, and assumes a high logic level which is defined by a first voltage value, for example 5 volts, when the cold side of the electroinjector 2 is set to a voltage which is close to the voltage of the positive pole of the electrical energy source 16, and it assumes a low logic value which is defined by a second voltage value lower than the first, for example 0 volt, when the cold side of the electroinjector 2 is set to a voltage which is close to the voltage of the negative pole of the electrical energy source 16 (earthing voltage).

The second and third reaction signals FBV1 and FBV2 are used by the timing circuit 8 in order to carry out monitoring of the malfunctioning of the corresponding electroinjector 2, in the manner described in detail hereinafter.

The voltage-increasing circuit 32 comprises a load diode 70 (shown outside the voltage-increasing circuit 32 purely for reasons of convenience of representation), which is interposed between the first input terminal 12 of the piloting circuit 10 and the supply line 22, and which in particular has the anode connected to the first input terminal 12 and the cathode connected to the supply line 22; a voltage converter 72 of the DC/DC type (switching converter of the direct current/direct current type, to increase the input voltage), for generation of a voltage which is greater than that supplied by the electrical energy source 16, with an input terminal 74 connected to the first input terminal 12, a first output terminal 76 connected to the supply line 22 via a transfer transistor 78, and a second output terminal 80 connected to the earthing line 24.

In particular, the load diode 70 defines a controlled switch which permits selective connection between the supply line 22 and the first input terminal 12 of the piloting circuit 10, on the basis of the voltage value present at the ends of the load diode 70 itself.

The transfer transistor 78 is a MOSFET transistor which has a control terminal connected to the timing circuit 8, and receives from the latter a third timing signal $T_3$, a sink terminal connected to the first output terminal 76 of the voltage converter 72, and a source terminal connected to the supply line 22.

The voltage converter 72, which is of a known type and is therefore not described in detail, substantially comprises an inductor 82 which has a first terminal connected to the first input terminal 74, and a second terminal connected to the anode of a transfer diode 84, the cathode of which is connected to the first output terminal 76.

The voltage converter 72 additionally comprises a load transistor 86 of the MOSFET type with a control terminal which receives (from a controller which is of a known type and is not illustrated) a control signal for piloting of the load transistor 86 itself in the event of saturation or cut-off, a sink terminal which is connected to the anode of the transfer diode 84, and a source terminal which is connected to the earthing line 24.

The high voltage circuit 32 additionally comprises a capacitor 88 which has a first and a second terminal connected respectively to the first output terminal 76 of the voltage converter 72 and to the earthing line 24.

The voltage-increasing circuit 32 additionally comprises a plurality of recirculation diodes 89, one for each control circuit 30 (shown outside the voltage-increasing circuit 32 purely for reasons of convenience of representation), which has the anodes connected to respective second output terminals 20 of the piloting circuit 10, and the cathodes connected to the first output terminal 76 of the voltage converter 72.

With reference once again to FIG. 1, the timing circuit 8 comprises a microprocessor 90 which receives as input the data signals S measured on the engine 6, and which, on the basis of the data signals S, generates as output operative data for control of the injectors 2; and a control circuit 92 which is connected at its input to the microprocessor 90, and which, in addition to the operative data supplied by the microprocessor 90 itself, receives the first, the second and third reaction signals FBI, FBV1 and FBV2 generated by the piloting circuit 10, and generates as output, on the basis of the said operating data and the reaction signals FBI, FBV1 and FBV2, the timing signals T for the piloting circuit 10 itself, thus implementing the control method which is the subject of the present invention.

The control circuit 92 also generates as output an interrupt signal INT which is supplied to the microprocessor 90 in order to interrupt its operations in particular operating situations, as described in greater detail hereinafter.

In particular, in a known manner, on the basis of data signals S, the microprocessor 90 generates as output a first and second series of binary data i.e. DATA, ADDRESS, which indicates the temporal duration of the intervals of activation of the piloting transistors 34 and 36, and of the transfer transistor 78 of the piloting circuit 10, which data is supplied to the control circuit 92 via data BUS lines.

The microprocessor 90 also generates as output trigger signals TRG of the pulse type, which are supplied to the control circuit 92, and have a (rising or descending) edge which indicates the start of injection into each cylinder of the engine 6.

The timing circuit 8 generates as output a number of first and second timing signals $T_1$, $T_2$ equivalent to the number of control circuits 30 which are connected to the supercharging circuit 32, i.e. equivalent to the number of electroinjectors 2 contained in a so-called "set", a third timing signal $T_3$ for each set of electroinjectors 2, and a state signal H/L for each set of electroinjectors 2, whereas it receives as input a number of first, second and third reaction signals FBI, FBV1 and FBV2 equivalent to the number of control circuits 30 connected to the supercharging circuits 32.

The timing circuit 8 activates each control circuit 30 selectively by supplying the timing signals $T_1$, $T_2$, $T_3$ to the control terminals of the corresponding piloting transistors 34 and 36, as well as to the control terminal of the transfer transistor 78 of the voltage-increasing circuit 32.

The timing signals $T_1$, $T_2$, $T_3$ are digital-type voltage signals and assume a high logic level, i.e. a logic level 1, for example of 5 volts, and a low logic level, i.e. a logic level 0, for example of 0 volt, in order to control the piloting transistors 34, 36 and the transfer transistor 78 respectively in the event of saturation and cut-off; each transistor therefore acts as an open or closed switch.

The timing signals $T_1$, $T_2$, $T_3$ are supplied in each case only to the control circuit 30 of the electroinjector 2 to be piloted, or to the control circuits 30 of the electroinjectors 2 to be piloted, and are not supplied to the other control circuits 30, which are therefore inactive.

The functioning of the control device 1 will now be described with reference to piloting of a single one of the electroinjectors 2, and thus the functioning will be described of a single one of the control circuits 30, which cooperates with the voltage-increasing circuit 32 for supply of the corresponding electroinjector 2.

The description for the other control circuits 30 is altogether similar, and therefore it will not be repeated.

Additionally, the description of the functioning of the control circuit 30 will refer to FIGS. 3–6, which illustrate the development over a period of time of the timing signals $T_1$, $T_2$, $T_3$ of the piloting transistors 34, 36 and the transfer transistor 78, as well as of the current $I_L$ which flows in the electroinjector 2.

There will then be described the method for controlling the piloting circuit 10 which is implemented by the timing circuit 8, and in particular by the control circuit 92.

As illustrated in FIGS. 3–6, initially, before the start of any operation for controlling the electroinjector 2, the voltage converter 72 loads the capacitor 88 in a known manner such that at its ends there is present a voltage $V_C$ which is greater than the voltage $V_B$ supplied by the electrical energy source 16.

In particular, in order to carry out the said loading on the control terminal of the load transistor 86, a set of pulses is supplied in order to command repeatedly closing and opening of the load transistor 86 itself, thus giving rise to a progressive increase to a pre-determined value of the voltage at the ends of the capacitor 88, such as to permit subsequent piloting of the electroinjector 2.

In fact, when the load transistor 86 is closed, a closed loop is formed, comprising the inductor 82, the load transistor 86 and the electrical energy source 16. Since the inductor 82 is supplied with a constant voltage by the electrical energy source 16, an increasing current passes through it, which gives rise to an increase in the energy accumulated in the inductor 82 itself.

When the load transistor 86 is opened, the current in the aforementioned loop is interrupted, and thus the storage of energy in the inductor 82 is interrupted.

After the load transistor 86 has been opened, the capacitor 88 and the inductor 82 are connected to one another in series via the transfer diode 84, and thus current flows in the loop defined by the inductor 82, the transfer diode 84 and the capacitor 88, which loads the capacitor 88 and gives rise to an increase in the voltage at its ends.

Thus, unless there are leakages, the energy which is stored in the inductor 82 is transferred to the capacitor 88.

The continual repetition of closing and opening of the transfer transistor 78 thus gives rise to a gradual increase in the voltage at the ends of the capacitor 88.

When the step of loading the capacitor 88 has been completed, the timing circuit 8 commands opening of the piloting transistors 34, 36 and the transfer transistor 78, and thus the control circuit 30 is inactive, and there is no electrical connection between the voltage-increasing circuit 32 and the supply line 22.

Subsequently, the timing circuit 8 initially commands closing of the piloting transistors 34, 36 and the discharge transistor 78, for a pre-determined interval of time, indicated as $t_1$ in FIGS. 3 and 6, and starting from an instant of time indicated as $t_0$, thus starting the socalled "LAUNCHING STEP", in which there is generated a current which increases rapidly over a period of time, up to a value which is sufficient to command opening of the electroinjector 2.

In particular, during the LAUNCHING STEP, the transfer transistor 78 connects the supply line 22 to the first terminal of the capacitor 88, thus determining the existence of a difference in voltage between the supply line 22 itself and the earthing line 24, which difference is equivalent to the voltage $V_C$ which exists at the ends of the capacitor 88.

In addition, closing of the piloting transistors 34, 36 gives rise to the formation of a loop which comprises the capacitor 88, the electroinjector 2 and the piloting transistors 34 and 36, and in which there flows a current derived from the energy stored in the capacitor 88.

Simultaneously, the capacitor 88 is kept loaded with the voltage $V_C$ by the voltage converter 72, in the manner previously described.

Figures 3, 4, 5, 6:
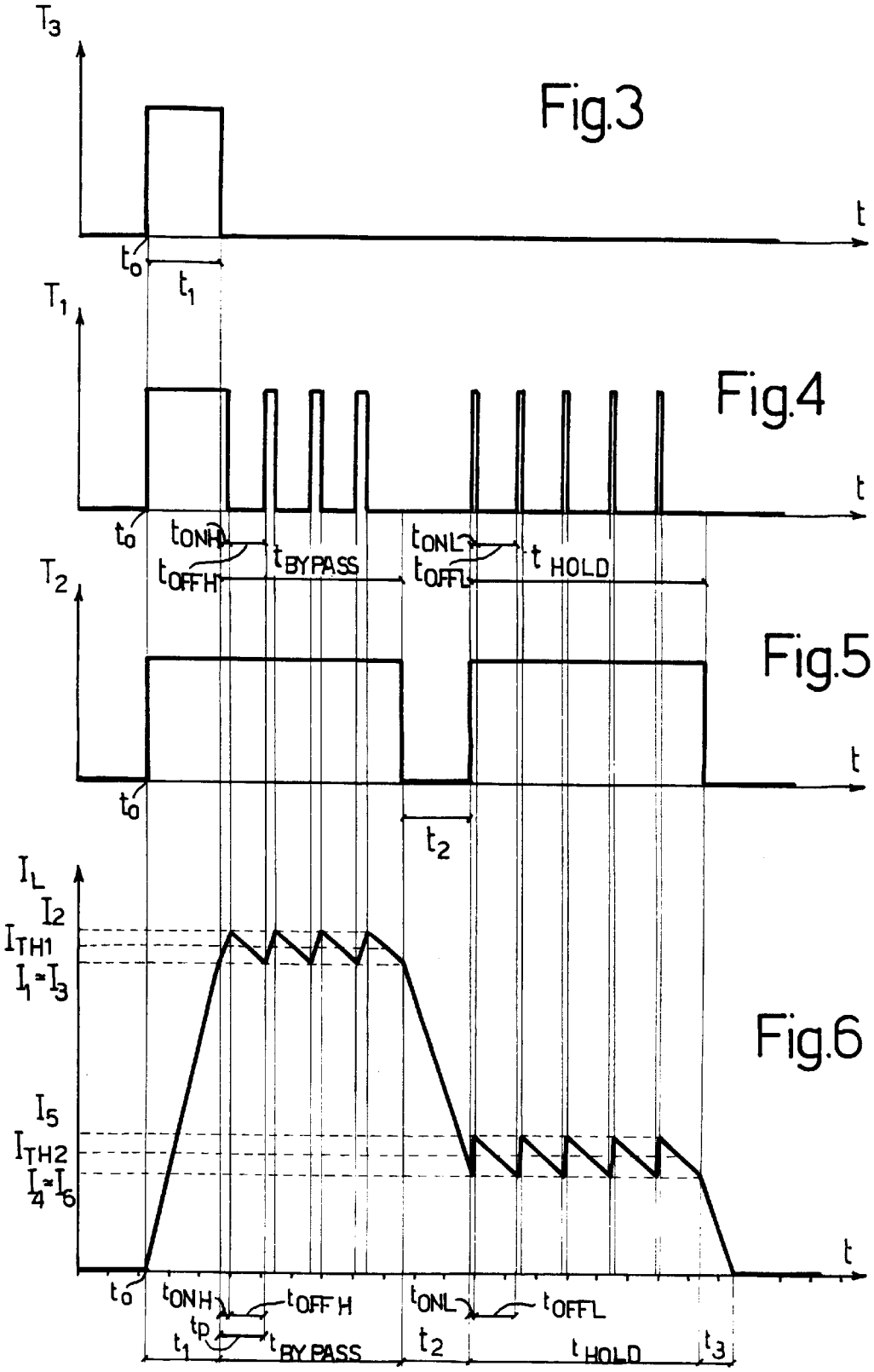
FIGS. 3–6 show developments over a period of time of quantities relating to the control device in FIG. 2.

As shown in FIG. 6, during the LAUNCHING STEP the current $I_L$ which flows in the electroinjector 2 increases substantially linearly, with a slope which is equivalent to $V_C/L$, in which L is the equivalent inductance of the electroinjector 2 and $V_C$ is the voltage at the ends of the capacitor, up to a value $I_1$ which is equivalent to $V_C{*}t_1/L$, such as to command instantaneous opening of the electroinjector 2 itself.

It should be noted that the value $I_1$ of the current which flows in the electroinjector 2 during the LAUNCHING STEP, and thus the first average value $I_{TH1}$ around which the current oscillates during this step, depends on the value of the voltage $V_C$ at the ends of the capacitor 88; thus the value of the voltage $V_C$ is typically determined a priori (and is obtained by controlling the voltage converter 72 accordingly), according to the current value to be obtained during the LAUNCHING STEP, in order to command closing of the electroinjector 2.

On completion of the LAUNCHING STEP, the timing circuit 8 commands opening of the transfer transistor 78, thus determining interruption of the connection between the supply line 22 and the capacitor 88, and the start of the so-called "BYPASS STEP", in which the current which flows in the electroinjector 2 is maintained around an average value, such as to command opening of the electroinjector 2.

In particular, during the BYPASS STEP, the timing circuit 8 commands closing and opening of the piloting transistor 34 repeatedly, and for a pre-determined time interval which is indicated as $t_{BYPASS}$ in FIGS. 4 and 6, such that the current which flows in the electroinjector 2 assumes a sawtooth development which has a duration $t_P$, and oscillates around a first average pre-determined value, for example 20 A, which is indicated as $I_{TH1}$ in FIG. 6.

In particular, when the connection transistor 78 is opened, since the piloting transistor 34 is closed, the timing circuit 8 continues to keep the latter closed for a pre-determined time interval, which is indicated as $t_{ONH}$ in FIGS. 4 and 6.

By this means, during the time interval $t_{ONH}$, the current continues to reach the electroinjector 2, by flowing in the loop which comprises the electrical energy source 16, the load diode 70, the electroinjector 2, and the piloting transistors 34 and 36.

In particular, during the time interval $t_{ONH}$, the electrical energy source 16 supplies a constant voltage to the electroinjector 2, through which there therefore passes an increasing current which keeps the electroinjector open.

As shown in FIG. 6, the current which flows in the electroinjector 2 continues to increase, but with a slope which is lesser than the slope obtained in the launching step.

In particular, during the time interval $t_{ONH}$, the current which flows in the electroinjector 2 increases substantially linearly, with a slope which is equivalent to $V_B/L$, in which $V_B$ is the voltage supplied by the electrical energy source 16, up to a value $I_2$ which is equivalent to $I_1+V_B{*}t_{ONH}/L$.

After the time interval $t_{ONH}$, the timing circuit 8 commands opening of the piloting transistor 34 for a predetermined time interval indicated as $t_{OFFH}$ in FIGS. 4 and 6, and current derived from the energy stored in the electroinjector 2 flows in the loop which comprises the discharge diode 40, the piloting transistor 36 and the electroinjector 2.

In particular, during the time interval $t_{OFFH}$, the electroinjector 2 is discharged in the said loop, and the current which flows in the electroinjector decreases substantially linearly, with a slope which is equivalent to $V_D/L$, in which $V_D$ is the voltage present at the ends of the electroinjector 2, up to a value $I_3$ which is equivalent to $I_2-V_D{*}t_{OFFH}/L$, and is approximately equal to $I_1$.

Thus, repetition of closing and opening of the piloting transistor 34 provides a current $I_L$ which flows in the electroinjector 2 with the sawtooth development which has a duration $t_P$, which is obviously equivalent to the sum of the times $t_{ONH}$ and $t_{OFFH}$, and oscillates around the first average value $I_{TH1}$ illustrated in FIG. 6.

On completion of the BYPASS STEP, with the piloting transistor 34 open, for a pre-determined time interval indicated as $t_2$ in FIGS. 5 and 6, the timing circuit 8 also commands opening of the piloting transistor 36, thus starting the so-called "FIRST DISCHARGE STEP", in which the current $I_L$ decreases substantially linearly.

In particular, when the piloting transistor 36 is also opened, a loop is formed which comprises the capacitor 88, the electroinjector 2, the re-circulation diode 89 and the discharge diode 40, and the electrodiode 2 is discharged in this loop.

The discharge current of the electroinjector 2 thus loads the capacitor 88, and the voltage at its ends increases.

As shown in FIG. 6, during discharge of the electroinjector 2, the current which flows in it decreases substantially linearly, with a slope which is equivalent to $V_C/L$, up to a value $I_4$ equivalent to $I_3-V_C{*}t_2/L$.

After the time interval $t_2$, the FIRST DISCHARGE STEP is completed, and the timing circuit 8 commands closing of the piloting transistor 36, and repeatedly, for a predetermined time interval which is indicated as $t_{HOLD}$ in FIGS. 4 and 6, it commands closing and opening of the piloting transistor 34, thus giving rise to the start of the so-called "MAINTENANCE STEP", in which the current which flows in the electroinjector 2 is maintained around an average value which is sufficient to keep the electroinjector 2 open.

In particular, the MAINTENANCE STEP is substantially similar to the preceding BYPASS STEP, with the difference however that the current which flows in the electroinjector 2 assumes a sawtooth development which oscillates around a second, pre-determined average value which is lower than the first average value, for example 10 A, indicated as $I_{TH2}$ in FIG. 6, which is sufficient to keep the electroinjector 2 open.

In detail, during the MAINTENANCE STEP, and after closing of the piloting transistor 36, the timing circuit 8 commands opening of the piloting transistor 34 for a predetermined time interval, which is indicated as $t_{ONL}$ in FIGS. 4 and 6, and the current reaches the electroinjector 2, and flows, similarly to the process during the BYPASS STEP, in the loop which comprises the electrical energy source 16, the load diode 70, the electroinjector 2 itself, and the piloting transistors 34 and 36.

During the time interval $t_{ONL}$, an increasing current passes through the electroinjector 2, in a substantially linear manner, with a slope which is equivalent to $V_B/L$, up to a value $I_5$ which is equivalent to $I_4+V_B*t_{ONL}/L$.

It should be noted that the value $I_5$ of the current which flows in the electroinjector 2 during the MAINTENANCE STEP, and thus the second average value $I_{TH2}$ around which the current oscillates during this step, depends on the value of the voltage $V_B$ supplied by the electrical energy source 16, and no longer on the voltage $V_C$ at the ends of the capacitor 88.

After the time interval $t_{ONL}$, the timing circuit 8 commands opening of the piloting transistor 34 for a predetermined time interval which is indicated as $t_{OFFL}$ in FIGS. 4 and 6, and similarly to the process during the BYPASS STEP, a current derived from the energy stored in the electroinjector 2 flows in the loop which comprises the discharge diode 40, the piloting transistor 36 and the electroinjector 2.

During the time interval $t_{OFFH}$, the electroinjector 2 is discharged in the said loop, and the current which flows in it decreases substantially linearly with a slope equivalent to $V_D/L$, to a value IG which is equivalent to $I_5-V_D*t_{OFFL}/L$, and is approximately equivalent to $I_4$.

Thus, by repeating the closing and opening of the piloting transistor 34, a current $I_L$ flowing in the electroinjector 2 is obtained, which current has the oscillating sawtooth development around the second average value $I_{TH2}$ illustrated in FIG. 6.

On completion of the MAINTENANCE STEP, the timing circuit 8 commands opening of the piloting transistors 34, 36, thus starting the so-called "SECOND DISCHARGE STEP", in which the current $I_L$ which flows in the electroinjector 2 decreases substantially linearly.

In particular, after the piloting transistors 34, 36 have been opened, the electroinjector 2 is discharged in the loop which comprises the capacitor 88, the electroinjector 2 itself, the recirculation diode 89 and the discharge diode 40.

During discharge of the electroinjector 2, which takes place for a time interval indicated as $t_3$ in FIG. 6, the current which flows in the electroinjector decreases substantially linearly, with a slope equivalent to $V_C/L$, to a value of substantially zero.

When the time $t_3$ has elapsed since the piloting transistors 34 and 36 were opened, the timing circuit 8 can start a new piloting cycle of another electroinjector 2, repeating the operations previously described.

Examination of the characteristics of the control device 1 according to the present invention makes apparent the advantages which can be obtained by means of the invention.

Firstly, the fact that each electroinjector 2 is not connected directly either to the supply voltage or to earth means that any short-circuit to earth or to the supply voltage of one of the terminals of an electroinjector 2, does not cause damage either to the electroinjector 2 itself or to the control device 1, but simply gives rise to exclusion of this electroinjector 2, without affecting the functioning of the other electroinjectors 2, and thus without making the vehicle stall suddenly.

Furthermore, since the voltage converter 72 keeps the capacitor 88 constantly loaded, by means of the control device 1 it is possible to pilot several injectors 2 simultaneously, in order to carry out for example either successive injections into each cylinder, or simultaneous injections into several cylinders.

Finally, the control device 1 has a circuit structure which is decidedly simplified compared with that of the known control devices.

In order to obtain the above-described functioning of the piloting circuit 10, the control circuit 92 implements the operations described hereinafter with reference to FIGS. 7*a*–7*h*, and relative to the control method which is the subject of the present invention.

Similarly to the description given for functioning of the piloting circuit 10, the control method implemented by the control circuit 92 will now be described with reference to piloting of a single one of the electroinjectors 2.

As illustrated in FIGS. 7*a*–7*h*, initially a block 100 is reached in which, in a first register of the control circuit 92, there are stored the logic values (0 or 1) assumed by two flags F1 and F2, which for example are supplied by the engine control system (not shown).

In particular, to three of the possible combinations of the logic values assumed by the flags F1 and F2, there correspond respective control functions of the electroinjectors 2, which are implemented by the control circuit 92, and for each of these functions the microprocessor 90 generates respective binary DATA and ADDRESS data, whereas no control function corresponds to a fourth combination of the logic values assumed by the flags F1 and F2.

In detail, when the flag F1 assumes a high logic value (logic value 1) and the flag F2 assumes a low logic value (logic value 0), a control function of the electroinjectors 2 is implemented, which function comprises the LAUNCHING STEP, the BYPASS STEP, the first discharge step, the MAINTENANCE STEP and the SECOND DISCHARGE STEP previously described with reference to FIGS. 3–6, in order to generate a current $I_L$ which has the development illustrated in FIG. 6; when both the flags F1 and F2 assume high logic values, a control function of the electroinjectors 2 is implemented which makes it possible to obtain in the LAUNCHING STEP alone a development of the current $I_L$ which flows in each electroinjector 2, which is slightly different from that illustrated in FIG. 6; whereas when both the flags F1 and F2 assume low logic values, a socalled "anti-rebound" control function of the electroinjectors 2 is implemented.

However, on the other hand, the condition in which the flag F1 assumes a low logic value and the flag F2 assumes a high logic value is an unused condition, to which no method for controlling the electroinjectors 2 corresponds.

The control method described with reference to FIGS. 7*a*–7*h* will be described with reference initially to the method for controlling the electroinjectbrs 2 illustrated in FIGS. 3–6, i.e. with reference to the condition in which the flags F1 and F2 assume respectively a high and a low logic value. Subsequently, the control methods which can be obtained when the flags F1 and F2 assume the other logic values will be described.

With reference to the function for controlling the electroinjectors 2 which is illustrated in FIGS. 3–6, after storage of the logic values assumed by the flags F1 and F2, there is storage in a second register of the control circuit 92, of the first and second series of binary DATA and ADDRESS data supplied by the microprocessor 90, and which indicate the duration of the intervals of activation of the piloting transistors 34 and 36 and of the transfer transistor 78 of the piloting circuit 10 (block 100).

In particular, the first and second series of binary DATA and ADDRESS data define the values of each of the time intervals referred to in the description of FIGS. 3–6, i.e. they define in detail the duration of each of the sections which constitute the development of the current $I_L$ flowing in an electroinjector 2.

Subsequently, a method for controlling HARDWARE or SOFTWARE, which is to be implemented in the control device 1 (block 100) is also stored in a third register of the control circuit 92. In particular, when the present method is first executed, there is stored in the third register the HARDWARE control method, which can then optionally be modified during execution of the operations of the present control method.

In fact, the control device 1 can operate both in a HARDWARE control mode, in which the control circuit 92 uses the first reaction signal FBI in order to carry out a closed-loop check on the current $I_L$ flowing in the electroinjector 2, and uses the second and third reaction signals FBV1 and FBV2 to detect malfunctioning of the electroinjector 2, and it can operate in a SOFTWARE control mode, in which the control circuit 92 does not use the first reaction signal FBI, and carries out an open-loop check on the current $I_L$ flowing in the electroinjector 2, on the basis of the times stored in the second register of the control circuit 92 itself, and it uses only the second and third reaction signals FBV1 and FBV2 in order to detect malfunctioning of the electroinjector 2.

From block 100, there is then transition to a block 110 in which the first, second and third timing signals $T_1$, $T_2$, $T_3$ and the state signal H/L are set to the low logic level.

By this means the piloting transistors 34 and 36 and the transfer transistor 78 are cut off, and act as open circuits.

From block 110 there is transition to a block 120 in which it is verified whether the second reaction signal FBV1 is at the low logic level, in order to determine whether there is correct functioning or malfunctioning of the electroinjector 2 in relation to the operating state of the transistors 34, 36 and 78.

Figure 7A:
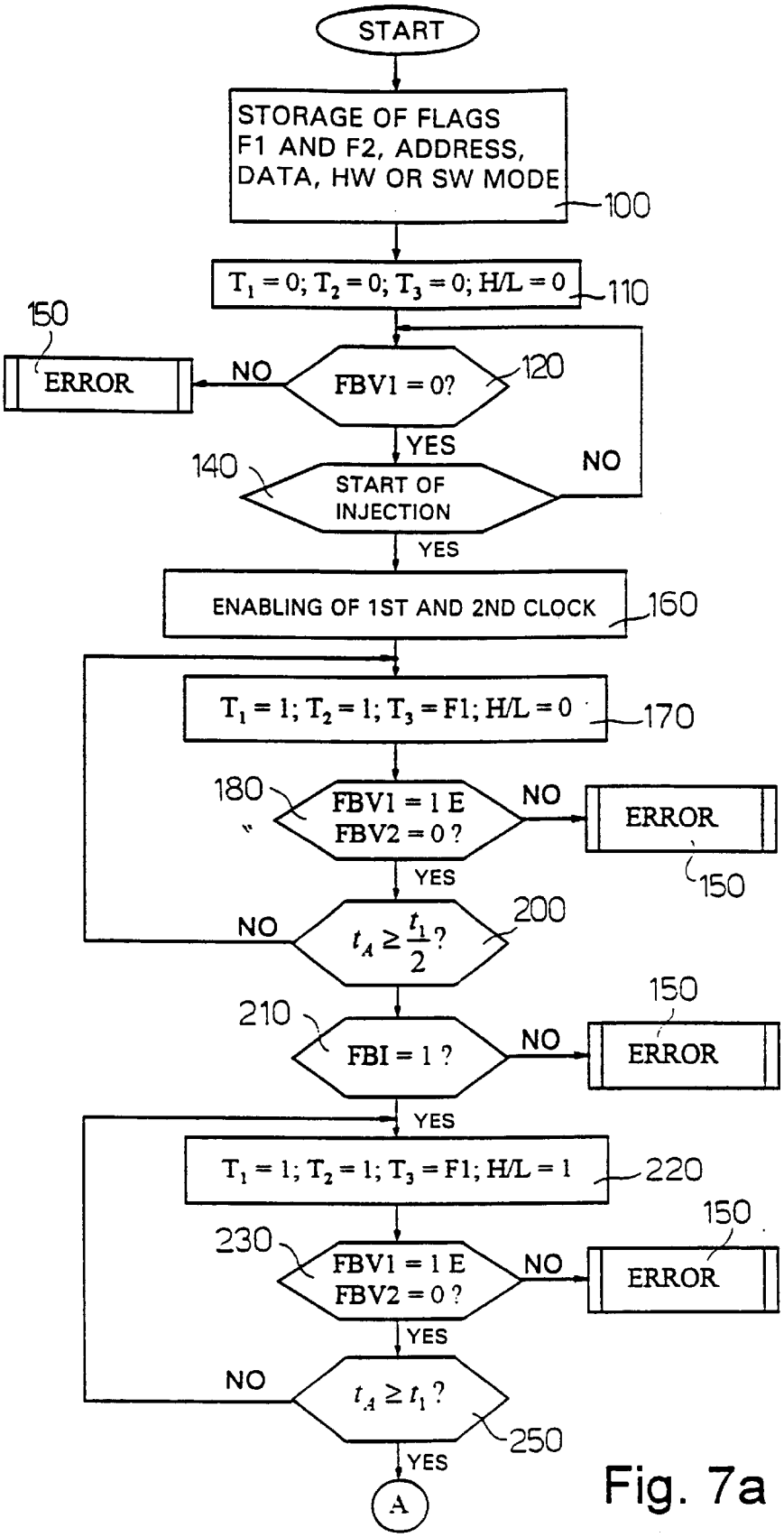
FIGS. 7*a*–7*h* show a flow chart relating to the control method which is the subject of the present invention.
Figure 7B:
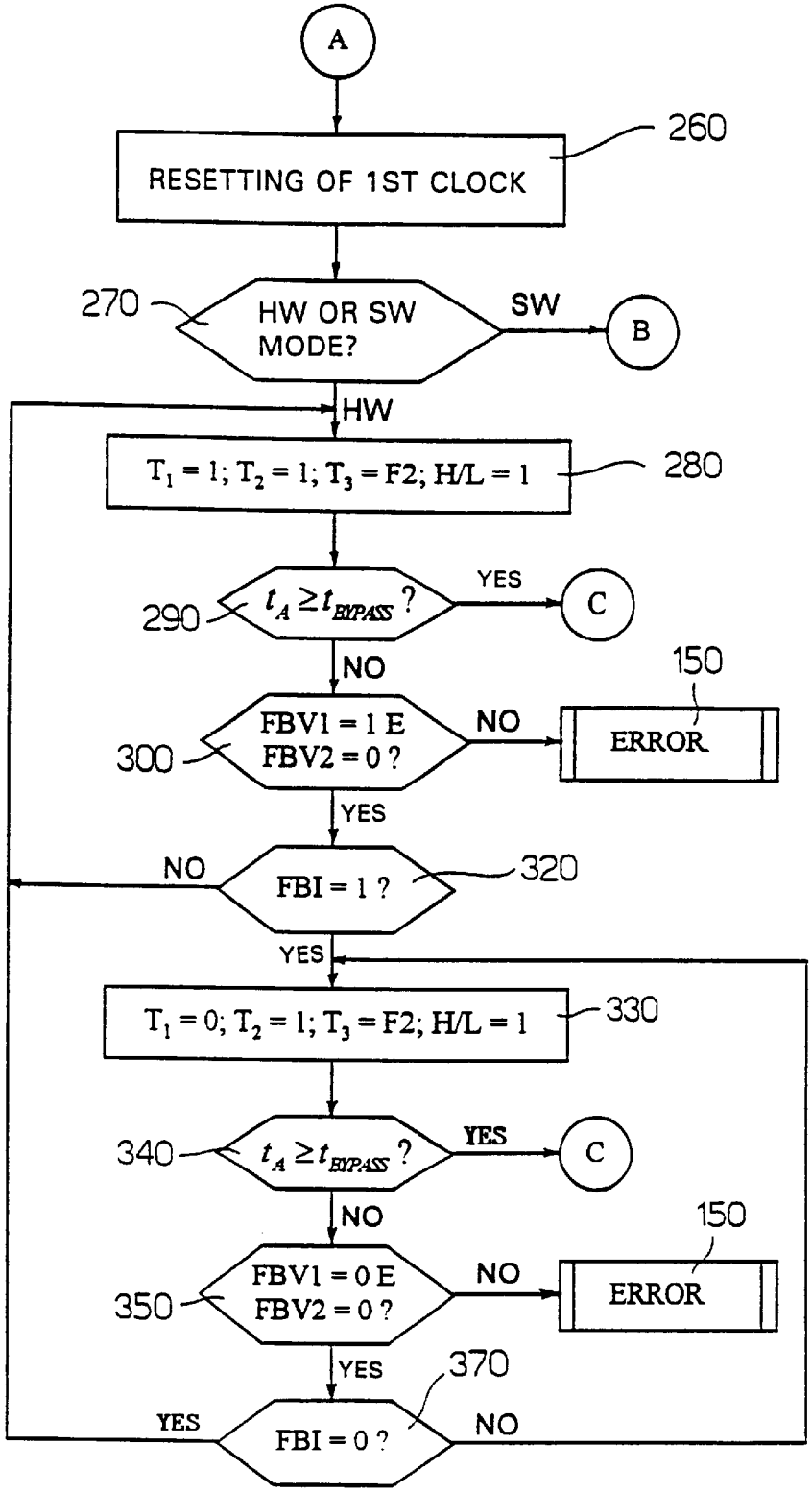
Figure 7C:
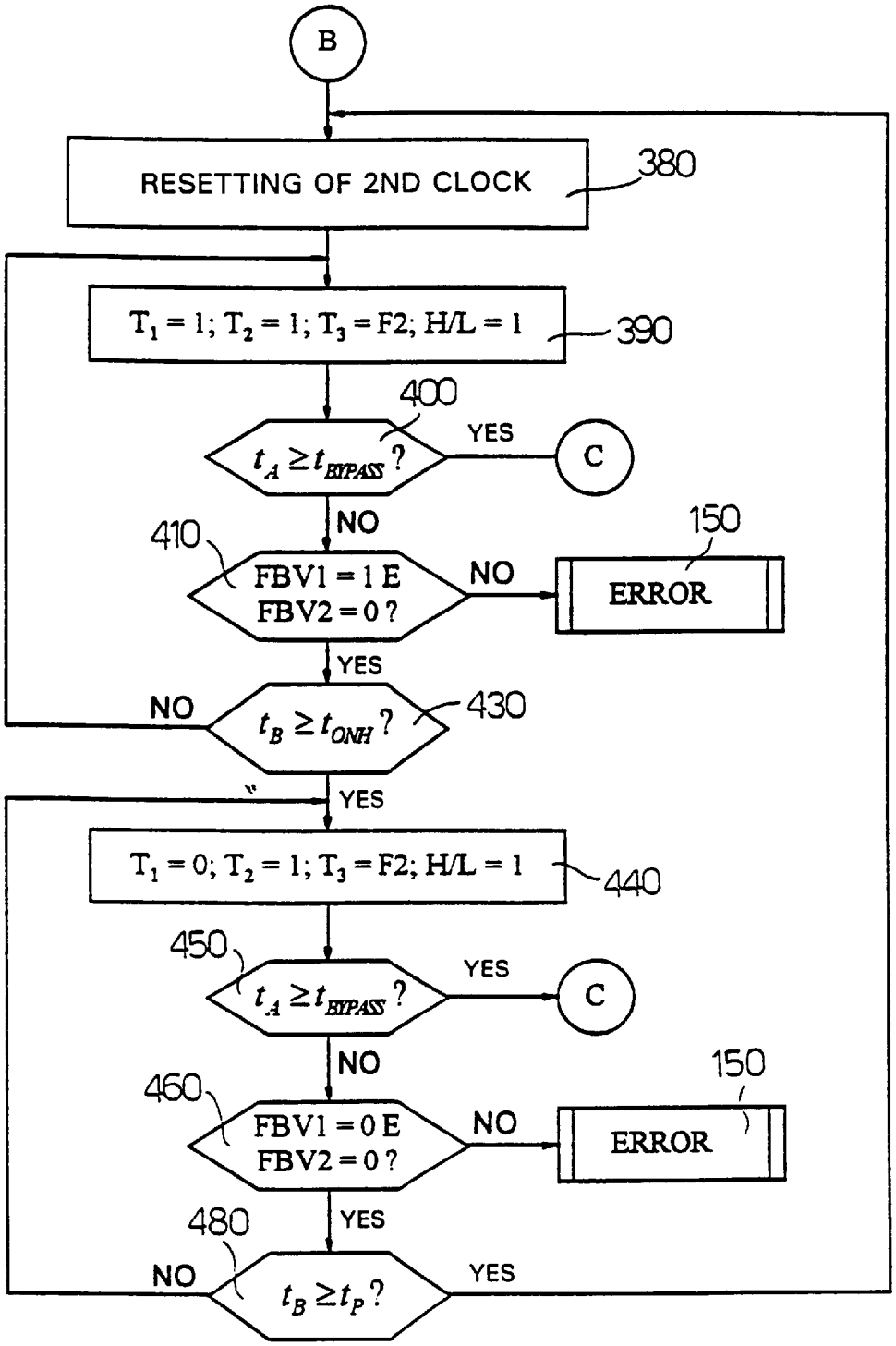
Figure 7D:
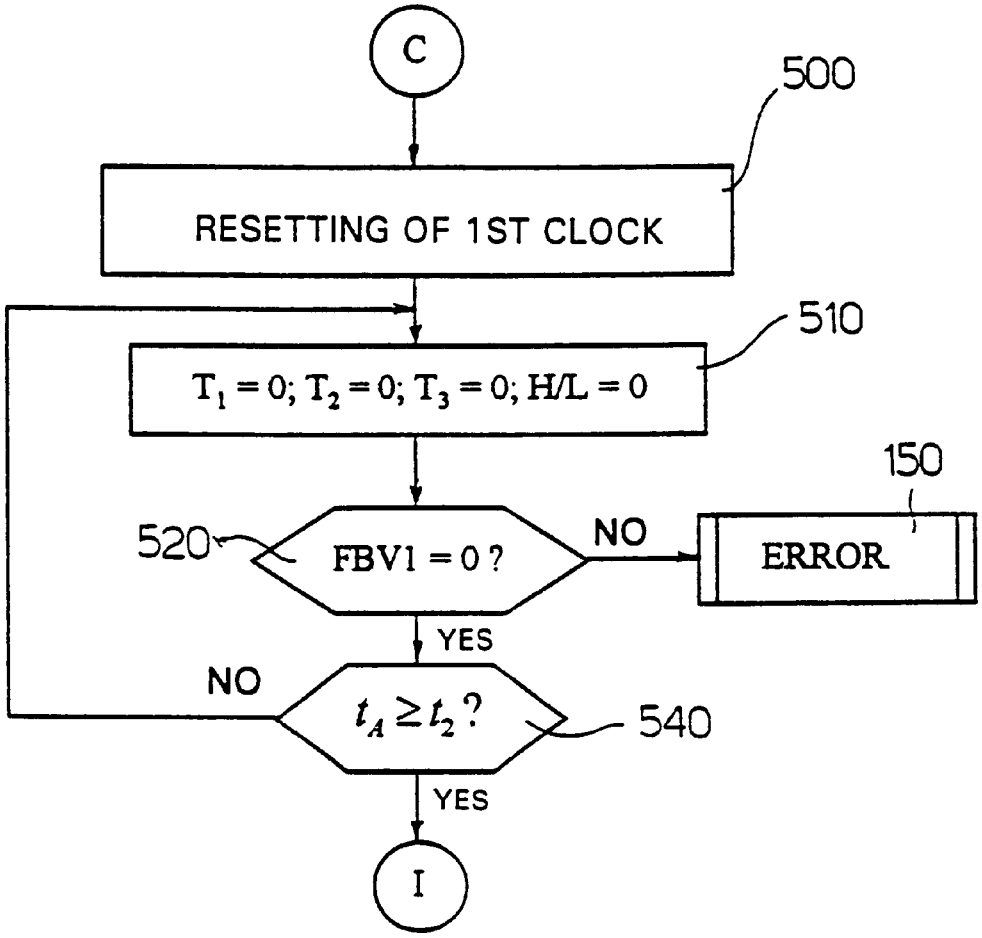
Figure 7E:
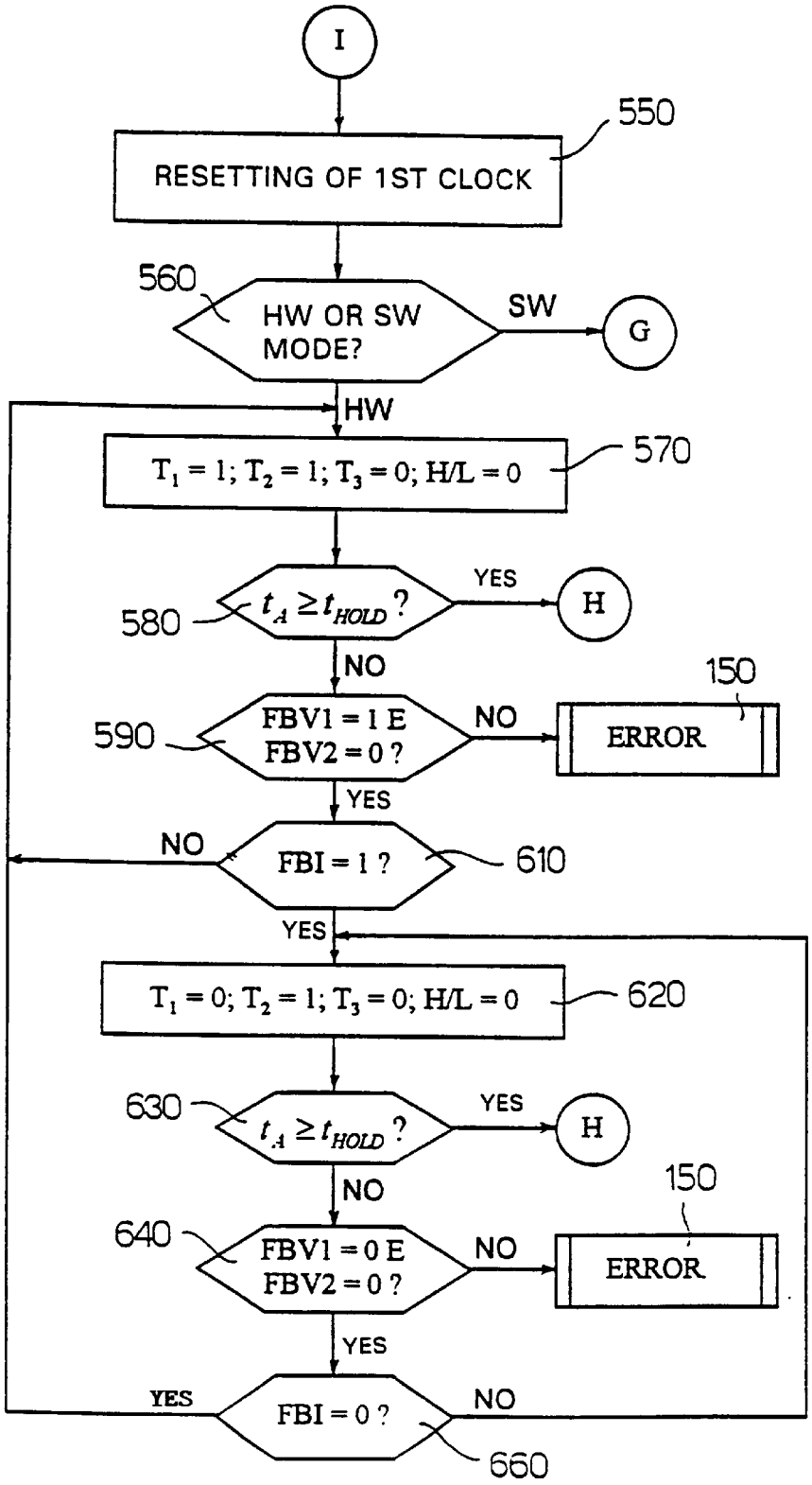
Figure 7F:
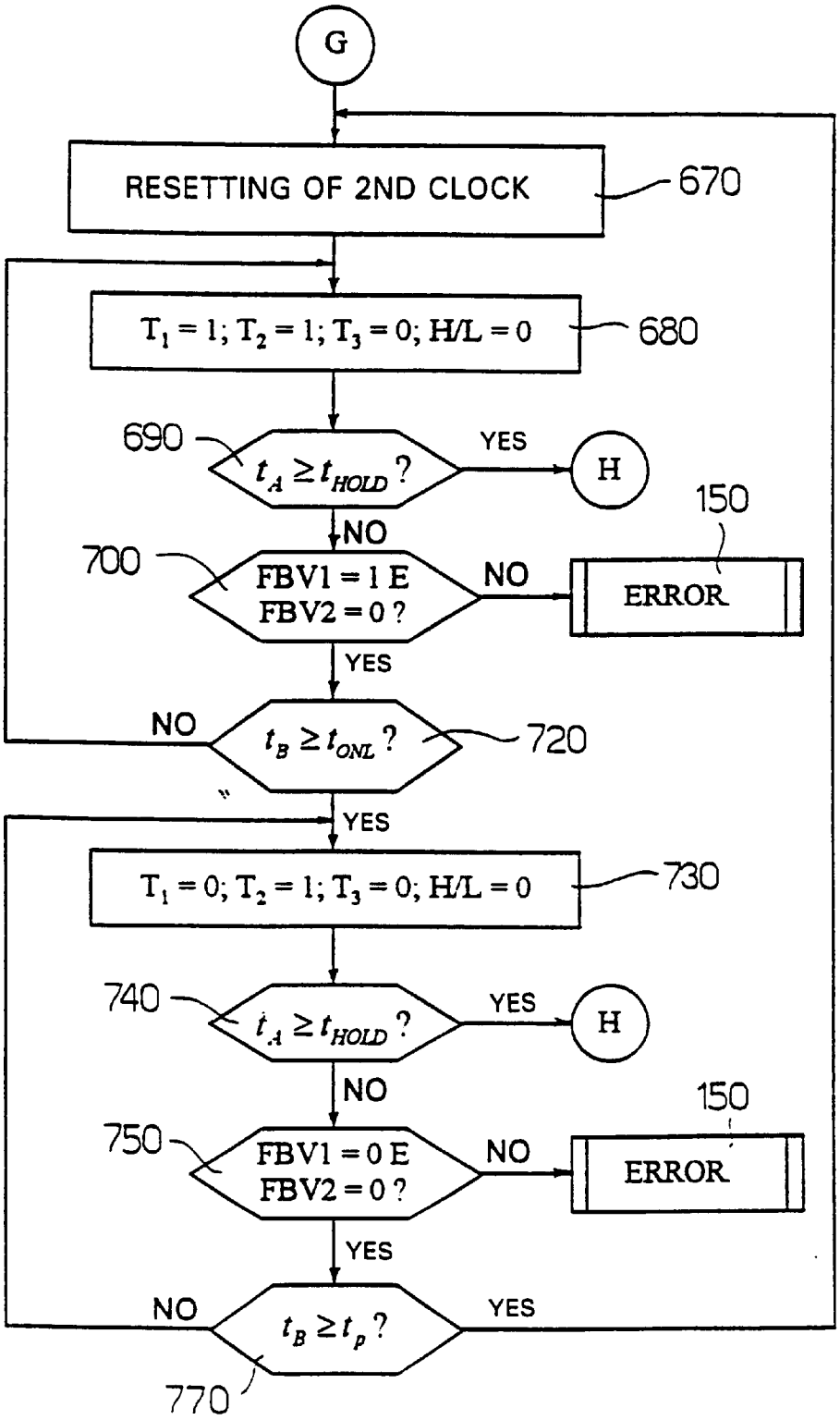
Figure 7G:
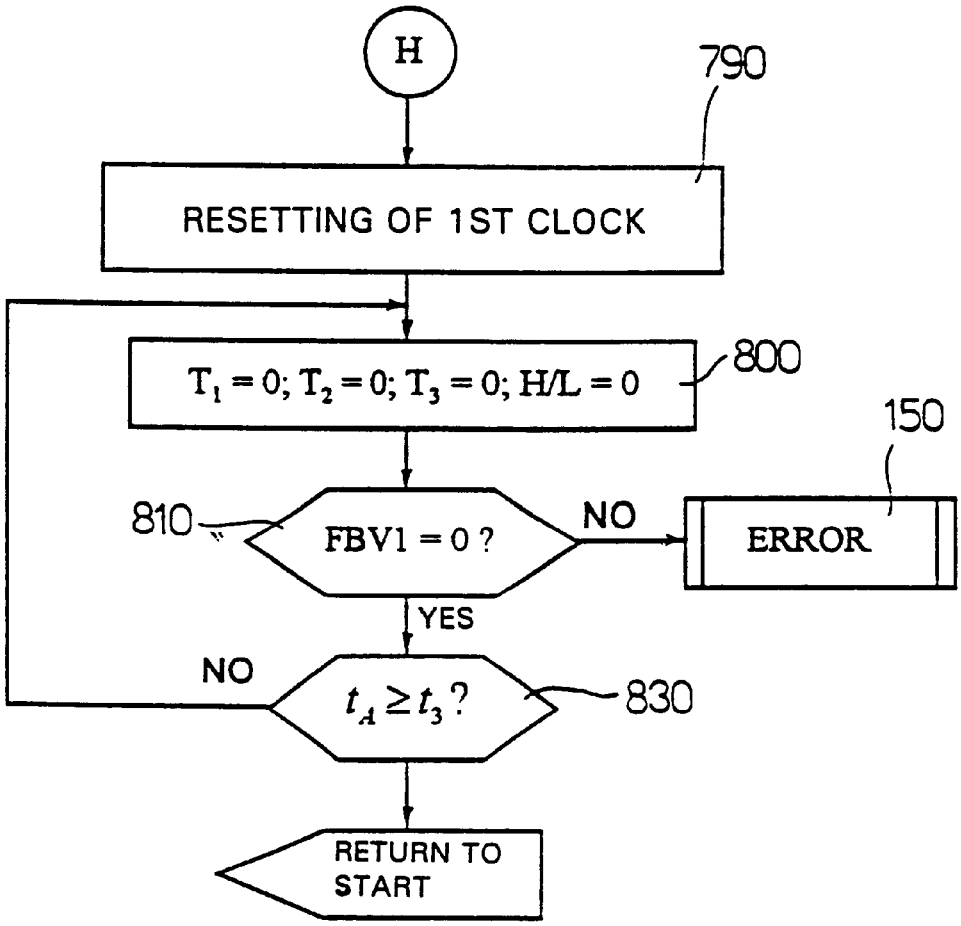
Figure 7H:
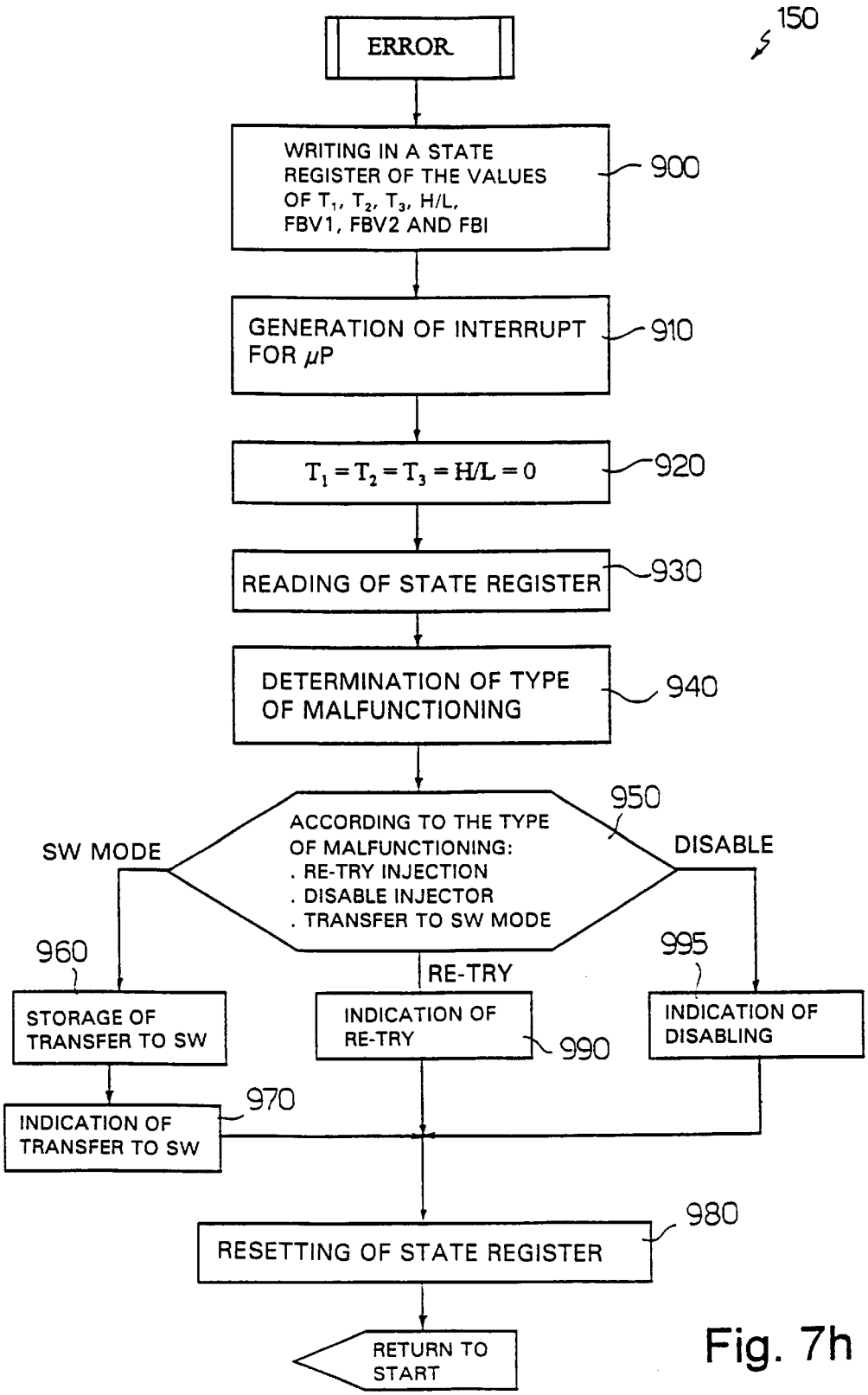
Figures 8, 9, 10, 11:
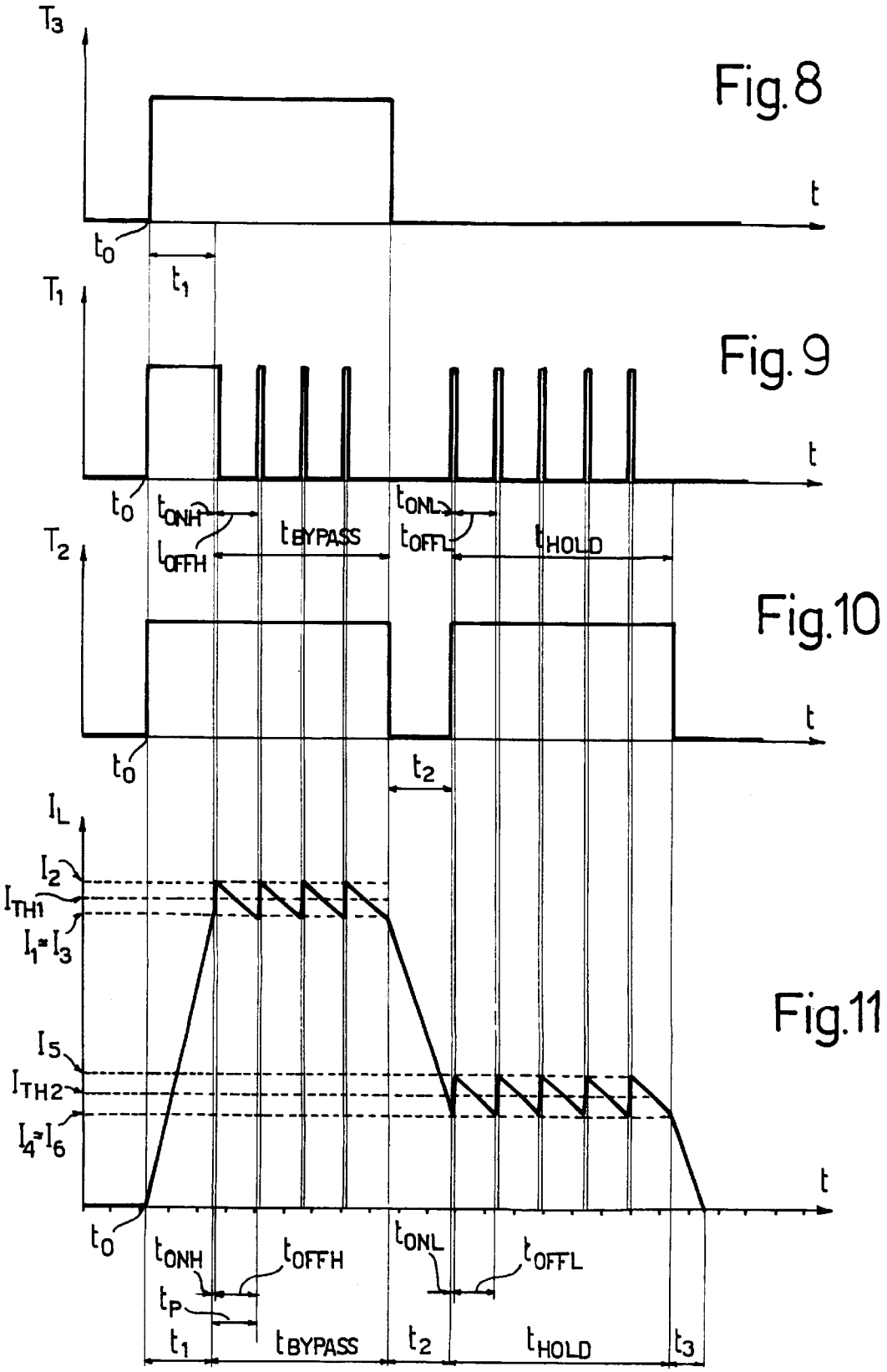
FIGS. 8–15 show development over a period of time of quantities relating to the control device in FIG. 2.

In particular, since with 34, 36 and 78 open, no current should flow in the electroinjector 2, and thus its hot side should be set to zero voltage, if the second reaction signal FBV1 is at the low logic level (YES output from block 120), then there is correct functioning of the electroinjector 2, and therefore from block 120 there is transition to a block 140, otherwise, if the second reaction signal FBV1 is at the high logic level (NO output from block 120), then there is malfunctioning of the electroinjector 2, and thus from block 120 there is transition to a block 150 in which a method is implemented to detect the type of malfunctioning and the appropriate action, which method is carried out using the sequence of operations illustrated in the figure, and described in detail hereinafter with reference to FIG. 7*h*.

In block 140 it is verified whether there is present an edge of transition of the trigger signal TRG generated by the microprocessor 90 for the electroinjector 2, and which indicates the start of injection into the cylinder of the engine 6 with which the electroinjector 2 itself is associated.

If there is present an edge of transition of the trigger signal TRG (YES output from block 140), then from block 140 there is transition to a block 160 in which a first and a second clock are enabled to measure respectively a time $t_A$ and a time $t_B$. Otherwise, if there is no edge of transition of the trigger signal TRG present (NO output from block 140), then from block 140 there is transition once again to block 120.

From block 160 there is then transition to a block 170 in which, simultaneously with the operation carried out in block 160, the first and second timing signals $T_1$, $T_2$ are set to the high logic level, the third timing signal $T_3$ is set to a logic level which is equivalent to that assumed by the flag F1, which, as previously stated, in the example in question is a high logic level, and the state signal H/L is maintained at the high logic level.

The operation carried out in block 170 starts the LAUNCHING STEP previously described with reference to FIG. 6, and in which there is generated a current which quickly increases to a value sufficient to command opening of the electroinjector 2.

From block 170 there is transition to a block 180 in which it is verified whether the second reaction signal FBV1 assumes a high logic level and the third reaction signal FBV2 assumes a low logic level, in order to determine whether there is correct functioning or malfunctioning of the electroinjector 2 in relation to the operating state of the transistors 34, 36 and 78.

In particular, since in the present operating state of the transistors, the hot side of the electroinjector 2 should be set to a positive voltage which is close to the voltage of the positive pole of the electrical energy source 16 (supply voltage) and the cold side should be set to a voltage which is close to the voltage of the negative pole of the electrical energy source 16 (earthing voltage), if the second reaction signal FBV1 assumes a high logic level and the third reaction signal FBV2 assumes a low logic level (YES output from block 180), then there is correct functioning of the electroinjector 2, and thus from block 180 there is transition to a block 200, otherwise, if the second reaction signal FBV1 assumes a low logic level, or if the third reaction signal FBV2 assumes a high logic level (NO output from block 180), then there is malfunctioning of the electroinjector 2, and thus from block 180 there is transition to block 150 for execution of the aforementioned method for detection of the type of malfunctioning.

In block 200 it is verified whether the time $t_A$ measured by the first clock is longer than, or the same as the time $t_1/2$, in which $t_1$, as previously stated and illustrated in FIG. 6, is the duration of the LAUNCHING STEP.

If the time $t_A$ is longer than, or the same as the time $t_1/2$ (YES output from block 200), then from block 200 there is transition to a block 210, otherwise, if the time $t_A$ is shorter than the time $t_1/2$ (NO output from block 200), then from block 200 there is transition once more to block 170.

In block 210 it is verified whether the first reaction signal FBI is at the high logic level, in order to determine whether there is correct functioning or malfunctioning of the electroinjector 2 in relation to the operating state of the transistors 34, 36 and 78.

In particular, since in the present operating state of the transistors halfway through the LAUNCHING STEP, there should flow in the electroinjector 2 a current which has a value such as to give rise to a voltage with a relatively high value at the ends of the shunt resistor 38, if the first reaction signal FBI is at the high logic level (YES output from block 210), then there is correct functioning of the electroinjector 2, and thus from block 210 there is transition to a block 220, otherwise, if the first reaction signal FBI is at the low logic level (NO output from block 210), then there is malfunctioning of the electroinjector 2, and thus from block 210 there is transition to block 150 for execution of the aforementioned method for detection of the type of malfunctioning.

In block 220, the state signal H/L is set to the high logic level, the first and second timing signals $T_1$, $T_2$ are kept at the high logic level, and the timing signal $T_3$ is kept at the logic level assumed by F1, i.e. high.

The state signal H/L set to a high logic level ensures that the comparator circuit 42 compares the voltage at the ends of the shunt resistor 38 with a high voltage value, thus supplying to the control circuit 92 a first reaction signal FBI which allows the control circuit 92 itself to carry out closed-loop control of the current $I_L$ which flows in the electroinjector 2, in order to maintain it around the average value $I_{TH1}$, as illustrated in FIG. 6.

From block 220 there is transition to a block 230, in which it is verified whether the second reaction signal FBV1 assumes a high logic level, and the third reaction signal FBV2 assumes a low logic level, in order to determine whether there is correct functioning or malfunctioning of the electroinjector 2, in relation to the operating state of the transistors 34, 36 and 78.

In particular, since in the present operating state of the transistors, the hot side of the electroinjector 2 should be set to a positive voltage which is close to the supply voltage, and the cold side should be set to the earthing voltage, if the second reaction signal FBV1 assumes a high logic level and the third reaction signal FBV2 assumes a low logic level (YES output from block 230) then the electroinjector 2 is functioning correctly, and thus there is transition from block 230 to a block 250. Otherwise, if the second reaction signal FBV1 assumes a low logic level, and/or the third reaction signal FBV2 assumes a high logic level (NO output from block 230), then there is malfunctioning of the electroinjector 2, and thus there is transition from block 230 to block 150, for execution of the aforementioned method for detection of the type of malfunctioning.

In block 250, it is verified whether the time $t_A$ measured by the first clock is longer than, or the same as the time $t_1$.

If the time $t_A$ is longer than, or the same as the time $t_1$ (YES output from block 250), then the LAUNCHING STEP is completed, and from block 250 there is transition from a block 260 in which the first clock is reset, otherwise, if the time $t_A$ is shorter than the time $t_1$ (NO output from block 250), then from block 250 there is transition once more to block 220.

From block 260 there is then transition to a block 270, in which it is verified whether the HARDWARE control mode or the SOFTWARE control mode is stored in the third register of the control circuit 92.

If the HARDWARE mode is stored (HW output from block 270), then there is transition from block 270 to a block 280, otherwise, if the SOFTWARE mode is stored (SW output from block 270), then from block 270 there is transition to a block 380 for execution of alternative operations to those described hereinafter with reference to the HARDWARE mode.

In block 280, the third timing signal T3 is set to a logic level which is the same as that assumed by the flag F2, which, as previously stated, in the example in question is a low logic level, whereas the first and second timing signals $T_1$, $T_2$ and the state signal H/L are maintained at the high logic level.

The operation described in block 280 starts the BYPASS STEP, in which, as previously stated, the current $I_L$ which flows in the electroinjector 2 assumes a sawtooth development around the average value $I_{TH1}$ and between extreme values $I_1$ and $I_2$, such as to command opening of the electroinjector 2.

In particular, the combination of the logic levels of the timing signals T set in block 280 starts the rising section of a sawtooth of the current $I_L$ contained between $I_1$ and $I_2$.

From block 280 there is transition to a block 290 in which it is verified whether the time $t_A$ measured by the first clock after it has been reset is longer than, or the same as the time $t_{BYPASS}$, in which $t_{BYPASS}$, as previously stated and illustrated in FIG. 6, is the duration of the BYPASS STEP.

If the time $t_A$ is longer than, or the same as the time $t_{BYPASS}$ (YES output from block 290), then from block 290 there is transition to a block 500 which is described hereinafter, otherwise, if the time $t_A$ is shorter than the time $t_{BYPASS}$ (NO output from block 290), then from block 290 there is transition to a block 300.

In block 300 it is verified whether the second reaction signal FBV1 assumes a high logic level, and the third reaction signal FBV2 assumes a low logic level, in order to determine whether there is correct functioning or malfunctioning of the electroinjector 2, in relation to the operating state of the transistors 34, 36 and 78.

In particular, if the second reaction signal FBV1 assumes a high logic level, and the third reaction signal FBV2 assumes a low logic level (YES output from block 300), then there is correct functioning of the electroinjector 2, and thus from block 300 there is transition to a block 320, otherwise, if the second reaction signal FBV1 assumes a low logic level, and/or the third reaction signal FBV2 assumes a high logic level (NO output from block 300), then there is malfunctioning of the electroinjector 2, for example because of a short-circuit to the earthing line 24, and thus from block 300 there is transition to block 150 for execution of the aforementioned method for detection of the type of malfunctioning.

In block 320 it is verified whether the first reaction signal FBI is at the high logic level, in order to determine whether the current $I_L$ which flows in the electroinjector 2 during the increase between the value $I_1$ and the value $I_2$, has reached and exceeded the threshold value $I_{TH1}$, and is therefore greater than the threshold value $I_{TH1}$.

It should be noted that the first reaction signal FBI is obtained as a result of the comparison of the difference of voltage which is present at the ends of the shunt resistor 38, with the logic level of the state signal H/L, which in this step is high, and in fact represents the term of comparison defined by the threshold value $I_{TH1}$.

If the first reaction signal FBI is at the high logic level (YES output from block 320), then the current $I_L$ has exceeded the threshold value $I_{TH1}$, and can start the descending section, and thus from block 320 there is transition to a block 330, otherwise, if the first reaction signal FBI is at the low logic level (NO output from block 320), then the current $I_L$ has not yet exceeded the threshold value $I_{TH1}$, and therefore from block 320 there is transition to block 280 once more.

In block 330 the first timing signal $T_1$ is set to the low logic level, whereas the second timing signal $T_2$ and the state signal H/L are maintained at the high logic level, and the third timing signal $T_3$ is maintained at the low logic level, thus starting the descending section of the current $I_L$ contained between $I_2$ and $I_1$.

From block 330 there is transition to a block 340, in which it is verified whether the time $t_A$ measured by the first clock after it has been reset is longer than, or the same as the time $t_{BYPASS}$.

If the time $t_A$ is longer than, or the same as the time $t_{BYPASS}$ (YES output from block 340), then from block 340 there is transition to block 500, otherwise, if the time $t_A$ is shorter than the time $t_{BYPASS}$ (NO output from block 340), then from block 340 there is transition to a block 350.

In block 350 it is verified whether the second and third reaction signals FBV1, FBV2 are both at the low logic level, in order to determine whether there is correct functioning or malfunctioning of the electroinjector 2 in relation to the operating state of the transistors 34, 36 and 78.

In particular, if the second and third reaction signals FBV1 are both at the low logic level (YES output from block 350), then there is correct functioning of the electroinjector 2, and thus from block 350 there is transition to a block 370, otherwise, if at least one of the second and third reaction signals FBV1, FBV2 is at the high logic level (NO output from block 350), then there is malfunctioning of the electroinjector 2, for example because of a short-circuit to the supply line 22, and therefore from block 350 there is transition to block 150 for execution of the aforementioned method for detection of the type of malfunctioning.

In block 370 it is verified whether the first reaction signal FBI is at the low logic level, in order to determine whether the current $I_L$ which flows in the electroinjector 2 during the decrease from the value $I_2$ to the value $I_1$, has crossed the threshold value $I_{TH1}$, and is therefore smaller than the threshold value $I_{TH1}$.

If the first reaction signal FBI is at the low logic level (YES output from block 370), then the current $I_L$ has crossed the threshold value $I_{TH1}$, and is therefore smaller than the threshold value $I_{TH1}$, and thus from block 370 there is transition once more to block 280, to start the rising section of a subsequent sawtooth, otherwise, if the first reaction signal FBI is at the high logic level (NO output from block 370), then the current $I_L$ has not yet crossed the threshold value $I_{TH1}$, and the threshold value $I_{TH1}$ is thus still greater, and therefore from block 370 there is transition once more to block 330.

The second clock is reset in block 380, to which there is transition if it is verified in block 270 that the SOFTWARE control mode is stored in the third register of the control circuit 92.

From block 380 there is transition to a block 390, in which the third timing signal $T_3$ is set to the logic level assumed by the flag F2, i.e. in the example in question it is set to the low logic level, whereas the first and second timing signals $T_1$, $T_2$ and the state signal H/L are maintained at the high logic level.

The operation carried out in block 390 starts the BYPASS STEP illustrated in FIG. 6, and in particular the combination of the logic levels of the timing signals T set in block 280 starts the rising section of the sawtooth of the current $I_L$ which is contained between $I_1$ and $I_2$ and has the duration $t_{ONH}$.

From block 390 there is transition to a block 400, in which it is verified whether the time $t_A$ measured by the first clock is longer than, or the same as the time $t_{BYPASS}$.

If the time $t_B$ is longer than, or the same as the time $t_{BYPASS}$ (YES output from block 400), then from block 400 there is transition to block 500, otherwise, if the time $t_B$ is shorter than the time $t_{BYPASS}$ (NO output from block 400), then from block 400 there is transition to a block 410.

In block 410 it is verified whether the second reaction signal FBV1 assumes a high logic level and the third reaction signal FBV2 assumes a low logic level, in order to determine whether there is correct functioning or malfunctioning of the electroinjector 2 in relation to the operating state of the transistors 34, 36 and 78.

In particular, if the second reaction signal FBV1 assumes a high logic level and the third reaction signal FBV2 assumes a low logic level (YES output from block 410), then there is correct functioning of the electroinjector 2, and thus from block 410 there is transition to a block 430, otherwise, if the second reaction signal FBV1 assumes a low logic level, or the third reaction signal FBV2 assumes a high logic level (NO output from block 410), then there is malfunctioning of the electroinjector 2, and thus from block 410 there is transition to block 150 for execution of the aforementioned method for detection of the type of malfunctioning.

In block 430 it is verified whether the time $t_B$ measured by the second clock is longer than, or the same as the time $t_{ONH}$.

If the time $t_B$ is longer than, or the same as the time $t_{ONH}$ (YES output from block 430), then from block 430 there is transition to block 440, otherwise if the time $t_B$ is shorter than the time $t_{ONH}$ (NO output from block 430), then from block 430 there is transition once more to block 390.

In block 440 the first timing signal $T_1$ is set to the low logic level, whereas the second timing signal $T_2$ and the state signal H/L are maintained at the high logic level, and the third timing signal $T_3$ is maintained at the low logic level assumed by the flag F2, thus starting the descending section of the current $I_L$ which is contained between $I_2$ and $I_1$, and has the duration $t_{OFFH}$.

From block 440 there is transition to a block 450, in which it is verified whether the time $t_A$ measured by the first clock is longer than, or the same as the time $t_{BYPASS}$.

If the time $t_A$ is longer than, or the same as the time $t_{BYPASS}$ (YES output from block 450), then from block 450 there is transition to block 500, otherwise if the time $t_A$ is shorter than the time $t_{BYPASS}$ (NO output from block 450), then from block 450 there is transition once more to a block 460.

In block 460, it is verified whether the second and third reaction signals FBV1, FBV2 are both at the low logic level, in order to determine whether there is correct functioning or malfunctioning of the electroinjector 2 in relation to the operating state of the transistors 34, 36 and 78.

In particular, if the second and third reaction signals FBV1, FBV2 are both at the low logic level (YES output from block 460), then there is correct functioning of the electroinjector 2, and thus from block 460 there is transition to a block 480, otherwise, if at least one out of the second and third reaction signals FBV1, FBV2 is at the high logic level (NO output from block 460), then there is malfunctioning of the electroinjector 2, and thus from block 460 there is transition to block 150 for execution of the aforementioned method for detection of the type of malfunctioning.

In block 480 it is verified whether the time $t_B$ measured by the second clock is longer than, or the same as a time $t_P$ which is equal to the sum of the time $t_{ONH}$ and the time $t_{OFFH}$, i.e. it is verified whether the time $t_B$ is longer than, or the same as the duration of a sawtooth of the current $I_L$ which flows in the electroinjector during the BYPASS STEP.

If the time $t_B$ is longer than, or the same as the time $t_P$ (YES output from block 480), then from block 480 there is transition once more to block 380, otherwise if the time $t_B$ is shorter than the time $t_P$ (NO output from block 480), then from block 480 there is transition once more to block 440.

In block 500, to which there is transition from blocks 290, 340, 400 and 450, if the time $t_A$ is longer than, or the same as the time $t_{BYPASS}$, the first clock is reset.

From block 500 there is transition to a block 510, in which the first, the second and the third timing signals $T_1$, $T_2$, $T_3$ and the state signal H/L are set to the low logic level, thus giving rise to the FIRST DISCHARGE STEP, which is intermediate between the BYPASS STEP and the MAINTENANCE STEP, in which the current flowing in the electroinjector 2 decreases substantially linearly during the time interval indicated as $t_2$ in FIG. 6.

From block 510 there is then transition to a block 520, in which it is verified whether the second reaction signal FBV1 is at the low logic level, in order to determine whether there is correct functioning or malfunctioning of the electroinjector 2 in relation to the operating state of the transistors 34, 36 and 78.

In particular, if the second reaction signal FBV1 is at the low logic level (YES output from block 520), then there is correct functioning of the electroinjector 2, and thus from block 520 there is transition to a block 540, otherwise, if at least one of the second and third reaction signals FBV1, FBV2 is at the high logic level (NO output from block 520), then there is malfunctioning of the electroinjector 2, and therefore from block 520 there is transition to block 150 for execution of the aforementioned method for detection of the type of malfunctioning.

In block 540 it is verified whether the time $t_A$ measured by the first clock is longer than, or the same as the time $t_2$.

If the time $t_A$ is longer than, or the same as the time $t_2$ (YES output from block 540), then the FIRST DISCHARGE STEP is completed, and the successive MAINTENANCE STEP can thus be started, followed by the SECOND DISCHARGE STEP. From block 540 there is transition to a group of blocks 550–830 (FIGS. 7*e*, 7*f*, 7*g*), otherwise, if the time $t_A$ is shorter than the time $t_2$ (NO output from block 540), then the FIRST DISCHARGE STEP is not yet completed, and from block 540 there is transition once more to block 510.

The operations described in blocks 550–830 relative to the MAINTENANCE STEP and the SECOND DISCHARGE STEP are similar to those described in blocks 260–540 relative to the BYPASS STEP and the FIRST DISCHARGE STEP, and differ from the latter in that the times $t_{BYPASS}$, $t_{ONH}$ and $t_2$ are replaced by the corresponding times of the MAINTENANCE STEP and of the SECOND DISCHARGE STEP, i.e. respectively $t_{HOLD}$, $t_{ONL}$ and $t_3$, and in that the state signal H/L now assumes the low logic level, such that the comparator circuit 42 compares the voltage at the ends of the shunt resistor 38 with a low voltage value, thus supplying the control circuit 92 with a first reaction signal FBI which allows the control circuit 92 itself to carry out closed-loop control of the current $I_L$ flowing in the electroinjector 2, in order to maintain it around the average value $I_{TH2}$ as illustrated in FIG. 6.

Owing to this similarity with the operations described in blocks 260–540, the operations illustrated in blocks 550–830 will not be described again.

As previously stated, in the event of detection of malfunctioning of an electroinjector 2, there is transition to a block 150, in which a method is implemented for detection of the type of malfunctioning and the appropriate action.

As illustrated in FIG. 7*h*, when the malfunctioning has been detected, there is transition initially to a block 900 in which, in a third state register of the control device 92, there are stored the present values assumed by the timing signals $T_1$, $T_2$, $T_3$, by the state signal H/L, and by the reaction signals FBI, FBV1 and FBV2.

From block 900 there is then transition to a block 910 in which the control device 92 generates an interrupt signal for the microprocessor 90.

From block 910 there is then transition to a block 920 in which the first, second and third timing signals $T_1$, $T_2$, $T_3$ and the state signal H/L are set to the low logic level.

From block 920 there is transition to a block 930 in which reading takes place of the values assumed by the timing signals $T_1$, $T_2$, $T_3$, by the state signal H/L and by the reaction signals FBI, FBV1 and FBV2 written in the aforementioned state register.

From block 930 there is then transition to a block 940 in which, on the basis of the values assumed by the timing signals $T_1$, $T_2$, $T_3$, by the state signal H/L, and by the reaction signals FBI, FBV1 and FVB2, there is determination of the type of malfunctioning of the electroinjector, for example by comparing these values with reference values stored in a table, which indicate various types of malfunctioning.

From block 940 there is then transition to a block 950 in which, on the basis of the type of malfunctioning determined, there is determination of the type of action to be implemented, i.e. it is decided whether to re-try the injection, to disable the malfunctioning electroinjector, or to transfer to the SOFTWARE control mode.

If, in block 950, it is decided to transfer to the SOFTWARE control mode (SW MODE output), for example because malfunctioning has been found in the comparator circuit 42 which generates the first reaction signal FBI, which is essential for the HARDWARE control mode, then from block 950 there is transition to a block 960 in which the SOFTWARE control mode is stored in the second state register of the control circuit 92, in which register the HARDWARE control mode had initially been stored (block 100).

From block 960 there is then transition to a block 970, in which the transfer to the SOFTWARE control mode is indicated.

From block 970 there is then transition to a block 980, in which the third state register of the control circuit 92 is reset.

From block 980 there is then transition to block 100 once more, for repetition of the above-described operations for a successive injection, but in this case using the SOFTWARE control mode instead of the HARDWARE control mode.

If, in block 950, it is decided to re-try the injection (RE-TRY output), then from block 950 there is transition to a block 990 in which re-trying of the injection is indicated.

From block 990 there is then transition to block 980 for resetting of the third state register, and from there transition takes place once more to block 100 for repetition of the above-described operation, using the HARDWARE control mode once more.

If on the other hand in block 950 it is chosen to disable the malfunctioning electroinjector 2 (DISABLING output), then from block 950 there is transition to a block 995 in which disabling of the malfunctioning electroinjector 2 is indicated.

From block 995 there is then transition to block 980, for resetting of the third state register, and from there transition takes place once more to block 100 for repetition of the above-described operations, for a successive injection which excludes the malfunctioning electroinjector 2.

As previously stated, when both the flags F1 and F2 assume high logic values, a function for controlling the electroinjectors 2 is implemented, which makes it possible to obtain development of the current $I_L$ flowing in each electroinjector 2, and is similar to that illustrated in FIG. 6, differing from the latter only in the LAUNCHING STEP, whereas when both the flags F1 and F2 assume low logic values, a so-called "anti-rebound" function for controlling the electroinjectors 2 is implemented.

In particular, when both the flags F1 and F2 assume high logic values, the developments of the timing signals T and of the current $I_L$ flowing in the electroinjectors 2 illustrated in FIGS. 8–11 are obtained.

As can be seen, the development of the current $I_L$ is similar to that illustrated in FIG. 6, and differs from the latter only during the LAUNCHING STEP, in particular in that it has a sawtooth development with ascending sections with a greater slope than that of the ascending sections in FIG. 6.

This difference is owing to the fact that on completion of the LAUNCHING STEP (time $t_1$), the timing signal $T_3$ is not switched to the low logic level, but is maintained at the high logic level also for the time $t_{BYPASS}$, thus keeping the transistor 78 closed also during the BYPASS STEP.

Consequently the supply line 22 is maintained at the voltage $V_C$ generated by the voltage-increasing circuit 32 also during the BYPASS STEP, and thus during the time intervals $t_{ONH}$ of this step, the current which flows in the electroinjector 2 increases substantially linearly with a slope equivalent to $V_C/L$, which is greater than the slope $V_B/L$ with which it increases if the transistor 78 is closed on completion of the LAUNCHING STEP.

On the other hand during the time intervals $t_{OFFH}$ of the BYPASS STEP, there are no variations of the slope with which the current flowing in the electroinjector 2 decreases.

Thus, in the method for controlling the electroinjectors 2 which is based on the presence of flags F1 and F2 with high logic values, the increase of the time for which the timing signal $T_3$ remains at the high logic level (equivalent to $t_1+t_{BYPASS}$), and the consequent increase in the slope of the ascending sections of the sawtooth development of the current $I_L$ flowing in the electroinjector 2 during the BYPASS STEP, for the same value $I_2$ which the current $I_L$ reaches during the BYPASS STEP, gives rise to an inevitable reduction of the value of the time $t_{ONH}$.

Consequently, the first and second series of binary DATA and ADDRESS data which are supplied by the microprocessor 90, and which indicate the duration of the intervals of activation of the piloting transistors 34 and 36 and of the transfer transistor 78 of the piloting circuit 10, will be different from those relating to the operative methods described with reference to FIGS. 3–6, in the part which relates to the value of the time $t_1$ and the time $t_{ONH}$.

On the other hand when the flags F1 and F2 assume low logic values, control of the electroinjectors comprises only the LAUNCHING STEP, the BYPASS STEP, and the FIRST DISCHARGE STEP, whereas the MAINTENANCE STEP and the SECOND DISCHARGE STEP are not carried out.

The developments of the timing signals T and of the current $I_L$ which flows in the electroinjectors 2 during these steps are illustrated in FIGS. 12–15.

As can be seen, the development of the current $I_L$ differs substantially from that illustrated in FIG. 6, since during the LAUNCHING STEP, the timing signal $T_3$ remains constantly set to the low logic level, thus keeping the transistor 78 constantly open.

Consequently, the supply line 22 is maintained constantly at the voltage $V_B$ supplied by the electrical energy source 16, and thus both during the LAUNCHING STEP and during the time intervals $t_{ONH}$ of the successive BYPASS STEP, the current $I_L$ which flows in the electroinjector 2 increases substantially linearly with a slope equivalent to $V_B/L$, in which $V_B$ is the voltage supplied by the electrical energy source 16, which is smaller than the slope $V_C/L$ with which it increases if the transistor 78 is closed during the LAUNCHING STEP.

On the other hand during the time intervals $t_{OFFH}$ of the BYPASS STEP, and during the time interval $t_2$ of the FIRST DISCHARGE STEP, there are no variations of the slope with which the current which flows in the electroinjector 2 decreases.

In particular, the current $I_L$ which flows in the electroinjector 2 during the LAUNCHING STEP increases to a value which is substantially the same as the value $I_4$ assumed by the current $I_L$ during the MAINTENANCE STEP illustrated in FIG. 6, whereas in the BYPASS STEP it has a sawtooth development which oscillates between values which are substantially the same as the values $I_5$ and $I_6$ assumed by the current $I_L$ during the MAINTENANCE STEP illustrated in FIG. 6.

Thus, in the method for controlling the electroinjectors 2 derived from the presence of flags F1 and F2 which have low logic values, compared with the occurrences described in FIGS. 3–6 the fact that the transistor 78 is not closed during the LAUNCHING STEP gives rise to an inevitable increase in the value of both the time $t_1$ and the time $t_{ONH}$ (and thus $t_{BYPASS}$) whereas the fact that the MAINTENANCE STEP and the SECOND DISCHARGE STEP are not carried out gives rise to inevitable elimination of the values of the times $t_{ONL}$, HOLD and $t_3$.

Consequently, the first and second series of binary DATA and ADDRESS data supplied by the microprocessor 90, and which indicate the duration of the intervals of activation of the piloting transistors 34 and 36 and of the transfer transistor 78 of the piloting circuit 10, will be different from those relative to the operating methods described with reference to FIGS. 3–6, both in the part relating to the value of the times $t_1$, $t_{ONH}$ and $t_{BYPASS}$, and in the part relating to the times $t_{ONL}$, $t_{HOLD}$ and $t_3$.

Figures 12, 13, 14, 15:
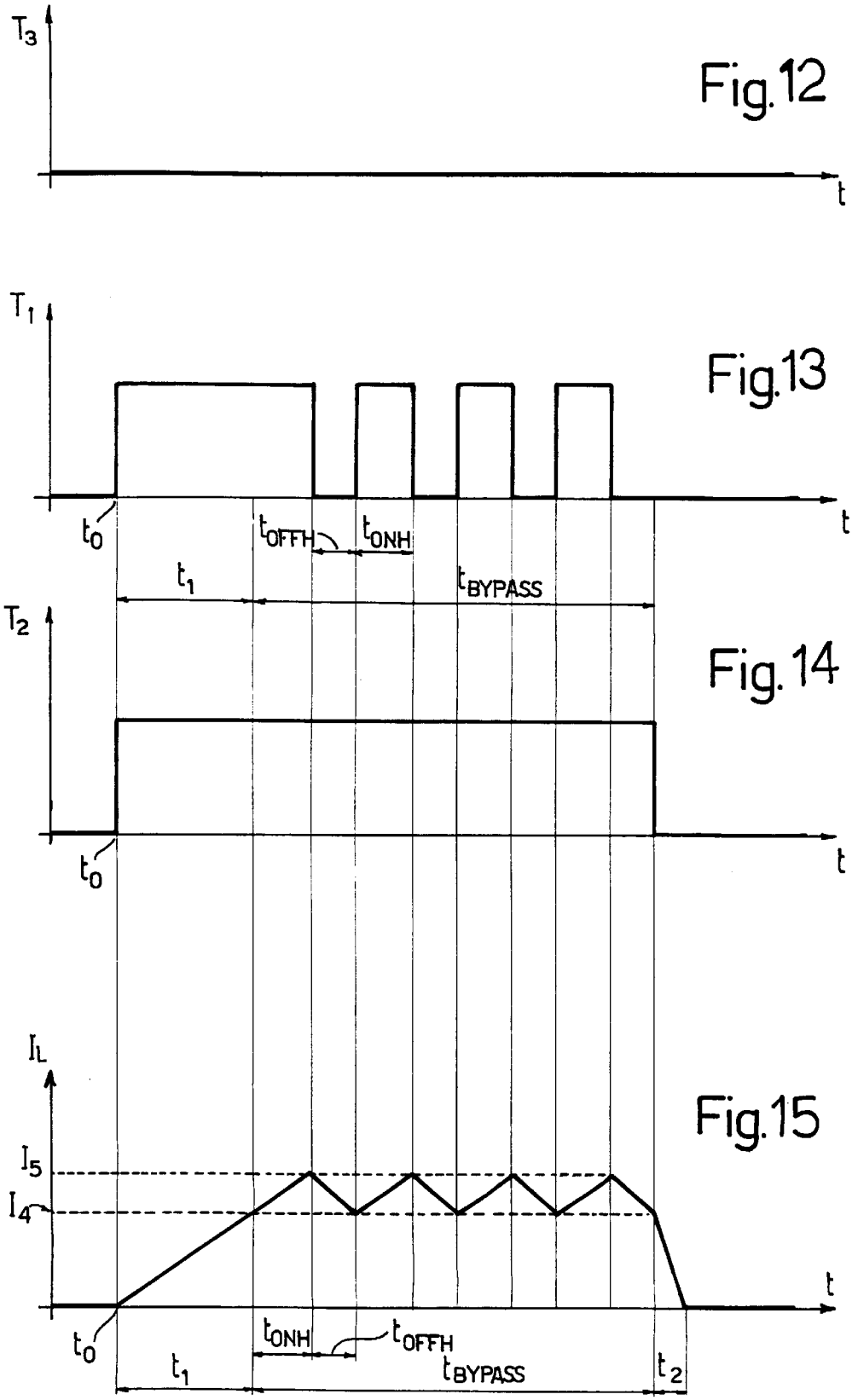

When an electroinjector 2 is supplied with a current $I_L$ which has the development illustrated in FIG. 15, an anti-rebound function can be implemented.

In fact, as is known, an electroinjector comprises an outer body which defines a cavity which communicates with the exterior by means of an injection nozzle, and in which there is accommodated a small rod loaded by a spring, which is mobile between a position of opening and a position of closing of the nozzle, and is normally maintained electromagnetically in the opening position, against the action of the spring.

It is also known that during closing of the electroinjector 2, there is generally rebound of the small rod onto the walls which delimit the injection nozzle, and this rebound consequently gives rise to instantaneous reopening of the nozzle, and thus to unwanted injection of a small quantity of fuel.

When the electroinjector 2 is supplied with a current $I_L$ which has the development illustrated in FIG. 15 during the course of the small rod towards the nozzle, there is exerted on the rod itself an action which is opposed to that exerted by the spring, which thus tends to decelerate the course of the rod itself towards the nozzle.

By calibrating satisfactorily this deceleration action, i.e. the values $I_4$, $I_5$ and $I_6$ assumed by the current $I_L$, it is possible to prevent the rebound of the small rod, and therefore to eliminate unwanted injection.

Examination of the characteristics of the control method according to the present invention makes apparent the advantages which the invention provides.

Firstly, the invention permits choice between a HARDWARE control mode and a SOFTWARE control mode for the control device 1, thus making it possible to carry out closed-loop control, by monitoring the current flowing in the electroinjectors 2, or open-loop control of the piloting device 10.

Additionally, it makes it possible to carry out diagnostics in real time of the piloting device 10, and provides the control device 1 with a high level of flexibility of programming.

Finally it is apparent that modifications and variants can be made to the control device 1 and the corresponding control method described and illustrated here, without departing from the protective context of the present invention.

For example, instead of having a single voltage-increasing circuit 32 which cooperates with a plurality of control circuits 30, the piloting device 10 could comprise a plurality of voltage-increasing circuits 32, each of which is connected to a respective control circuit 30, or to a respective group of control circuits 30, thus increasing further the versatility of use of the control device 1 itself, or it could comprise a single voltageincreasing circuit 32 which cooperates with a plurality of control circuits 30, by means of respective transistors 78 which are controlled independently from one another.

In particular, if the piloting device 10 comprises a plurality of voltage-increasing circuits 32, to each of which there is connected a group of control circuits 30 (or at least a single control circuit 30), the connection between each voltage-increasing circuit 32 and the corresponding control circuits 30 (or the corresponding control circuit 30), as well as the functioning of the latter, is altogether identical to that previously described with reference to FIG. 2, and is thus not described again.

In addition, the circuit structure of the piloting device 10 can be simplified in all cases in which the specific structure of the electroactuator used requires a control current which has a development such that the LAUNCHING STEP can be carried out simply by means of the voltage supplied by the electrical energy source 16.

In detail, in all cases in which, in order to open an electroactuator 2, it is sufficient to have a current which increases substantially linearly, with a slope which is smaller than that illustrated in FIG. 6, and up to a value lower than $I_1$, and which in particular increases with a slope equivalent to $V_B/L$ up to a value $I_1'=V_B*t_1/L$, the voltage-increasing circuit 32 can be eliminated, since its purpose is in fact to supply a voltage value which is greater than the voltage supplied by the electrical energy source 16, in order to carry out a LAUNCHING STEP in which the control current of the electroactuator 2 increases very rapidly to the value I, in the time $t_1$, which depends both on the electrical characteristics of the electroactuator 2 and on the temporal resolution specifications required.

If the voltage-increasing circuit 32 is not present, the supply line 22 is connected directly to the first input terminal 12, and the discharge of the electroinjector 2 caused by simultaneous opening of the piloting transistor 34 and of the piloting transistor 36, which previously took place in the loop comprising the recirculation diode 89 and the capacitor 88, now takes place via the parasitic diodes associated with the body area (body diode) of the piloting transistors 34, 36 themselves.

Finally, the control circuits 30 could be connected to a single shunt resistor 38, and in this case the control circuit 92 would receive as input a single first reaction signal FBI.

What is claimed is:

1. Control device for electroactuators comprising:

piloting means for the said electroactuators; and timing means which generate timing signals (T) supplied to the said piloting means in order to control the said electroactuators;

the said piloting means having a first and a second input terminal which are connected in use respectively to a first and a second terminal of an electrical energy source, and a plurality of pairs of output terminals, one for each of the said electroactuators; each pair of output terminals comprising a first and second output terminal between which a respective electroactuator is connected in use;

the said piloting means comprising a plurality of control circuits, one for each electroactuator, receiving as input the said timing signals (T), and being activated selectively by the timing signals (T) themselves for control of the respective electroactuators; characterised in that each of the said control circuits comprises:

first controlled switch means which are connected between a respective first output terminal, and, at least in pre-determined operating conditions, the first input terminal of the said piloting means, said first controlled switch means further comprising first transistor means;

second controlled switch means which are connected between a respective second output terminal and the second input terminal of the said piloting means, said second controlled switch means further comprising second transistor means; and third controlled switch means which are connected between the respective first output terminal and the second input terminal of the said piloting means.

2. Device according to claim 1, characterised in that the said first transistor means comprise a first transistor which has a control terminal connected to the said timing means, and receives from the latter a first timing signal ($T_1$), a first terminal which is connected, at least in the said predetermined operating conditions, to the said first input terminal of the said piloting means, and a second terminal which is connected to the said respective first output terminal of the piloting means themselves.

3. Device according to claim 1, characterised in that the said second transistor means comprise a second transistor which has a control terminal connected to the said timing means, and receives from the latter a second timing signal ($T_2$), a first terminal which is connected to a respective said second output terminal of the said piloting means, and a second terminal which is connected to the said second input terminal of the piloting means themselves.

4. Device according to claim 1, characterised in that the said third controlled switch means comprise a first single-pole switch.

5. Device according to claim 4, characterised in that the said first single-pole switch element comprises a first diode which has a cathode terminal connected to the said first output terminal of the said piloting means, and an anode terminal which is connected to the said second input terminal of the said piloting means themselves.

6. Device according to claim 2, characterised in that the said piloting means additionally comprise voltage increasing means which are connected to the said control circuits in order to supply the said electroactuators.

7. Device according to claim 6, characterised in that the said voltage-increasing means comprise a voltage-increasing circuit which is connected to the said control circuits, and comprises energy accumulation means, voltage-increasing means which are connected between the said first input terminal of the said piloting means and the said energy accumulations means, and fourth controlled switch means which are connected between the said energy accumulations means and the said control circuits, in order to permit selective transfer of energy between the said energy accumulation means and the said electroactuators.

8. Device according to claim 7, characterised in that the said voltage-increasing means comprise a voltage-increasing circuit which has an input terminal connected to the said first input terminal of the said piloting means, and first and second output terminals; and in that the said energy accumulation means comprise a capacitive element which is connected between the said first and second output terminals of the said voltage-increasing circuit.

9. Device according to claim 8, characterised in that the said fourth controlled switch means comprise third transistor means which are connected between the said first output terminal of the said voltage increasing circuit and the first terminals of the first transistors of the said control circuits; a second single-pole switch which is connected between the said first input terminal of the said piloting means and the first terminals of the first transistors of the said control circuits; and a plurality of third single-pole switches, one for each control circuit, connected between respective second output terminals of the said piloting means and the said first output terminal of the said voltage-increasing circuit.

10. Device according to claim 9, characterised in that the said third transistor means comprise a third transistor which has a control terminal connected to the said control means, and receives from the latter a third timing signal ($T_3$), a first terminal connected to the said first output terminal of the said voltage-increasing circuit, and a second terminal connected to the first terminals of the first transistors of the said control circuits.

11. Device according to claim 9, characterised in that the said second single-pole switch comprises a second diode which has an anode terminal connected to the said first input terminal of the said piloting means, and a cathode terminal connected to the first terminals of the first transistors of the said control circuits.

12. Device according to claim 9, characterised in that each of the said third single-pole switches comprises a third diode which has an anode terminal connected to the respective second output terminal of the said piloting means, and a cathode terminal connected to the said first output terminal of the said voltage-increasing circuit.

13. Device according to claim 2, characterised in that the said first, second and third transistors are MOSFET transistors.

14. Device according to claim 6, characterised in that the said voltage-increasing means comprise a plurality of voltage increasing circuits, each of which is connected to at least a respective one of the said control circuits; each of the said voltage-increasing circuits comprising energy accumulation means, voltage-increasing means connected between the said first input terminal of the said piloting means and the said energy accumulation means, and fifth controlled switch means connected between the said energy accumulation means and the corresponding control circuit, in order to permit selective transfer of energy between the said energy accumulation means and the relative electroactuator.

15. Device according to claim 14, characterised in that the said voltage-increasing means comprise a voltage-increasing circuit which has an input terminal connected to the said first input terminal of the said piloting means and a first and second output terminal; and in that the said energy accumulation means comprise a capacitate element which is connected between the said first and second output terminals of the said voltage-increasing circuit.

16. Device according to claim 15, characterised in that the said first controlled switch means comprise fourth transistor means connected between the said first output terminal of the said voltage-increasing circuit and the first terminal of the first transistor of the relative control circuit; a fourth single-pole switch connected between the said first input terminal of the said piloting means and the first terminal of the first transistor of the relative control circuit; and a fifth single-pole switch connected between the respective second output terminal of the said piloting means and the said first output terminal of the said voltage-increasing circuit.

17. Device according to claim 16, characterised in that the said fourth transistor means comprise a fourth transistor which has a control terminal connected to the said control means, and receives from the latter a fourth one of the said timing signals ($T_3$), a first terminal connected to the said first output terminal of the said voltage-increasing circuit and a second terminal connected to the first terminal of the first transistor of the relative control circuit.

18. Device according to claim 16, characterised in that the said fourth single-pole switch comprises a fourth diode which has an anode terminal connected to the said first input terminal of the said piloting means, and a cathode terminal connected to the first terminal of the first transistor of the relative control circuit.

19. Device according to claim 16, characterised in that the said fifth single-pole switch comprises a fifth diode which as an anode terminal connected to the said second output terminals of the said piloting means, and a cathode terminal connected to the said first output terminal of the said voltage increasing circuit.

20. Device according to claim 2, characterised in that the said first, second and fourth transistors are MOSFET transistors.

21. Method for controlling a control device according to claim 1, characterised in that it comprises the steps of:

a) selecting from between a first and second predetermined control mode (HARDWARE, SOFTWARE) of the said control device, an operative control mode (HARDWARE, SOFTWARE) to be implemented; the said first control mode (HARDWARE) making it possible to carry out closed-loop control of the said piloting means, and the said second control means (SOFTWARE) making it possible to carry out open-loop control of the said piloting means; and b) implementing the said operative control mode (HARDWARE, SOFTWARE).

22. Method according to claim 21, characterised in that the said first control mode (HARDWARE) comprises the steps of:

c) generating timing signals ($T_1$, $T_2$, $T_3$) which have first predetermined amplitudes;

d) supplying the said timing signals ($T_1$, $T_2$, $T_3$) to the said control circuits, in order to control the said electroactuators;

e) generating at least one first reaction signal (FBI) which is correlated to a first electrical quantity of the said electroactuators; and f) Modifying the first amplitudes of the said timing signals ($T_1$, $T_2$, $T_3$) according to the said first reaction signal (FBI).

23. Method according to claim 22, characterised in that the said first electrical quantity comprises the current ($I_L$) which flows in the electroactuators.

24. Method according to claim 22, characterised in that the said step f) comprises the steps of:

f1) comparing the amplitude of the said first reaction signal (FBI) with a first threshold value; and f2) modifying the amplitudes of the said timing signals ($T_1$, $T_2$, $T_3$) if the amplitude of the said first reaction signal (FBI) has a first predetermined ratio with the said first threshold value.

25. Method according to claim 24, characterised in that the said first reaction signal (FBI) can be switched between a first and a second level; in that the said step f1) comprises the step of:

f11) determining the level of the said first reaction signal (FBI); and in that the said step f2) comprises the step of:

f21) modifying the amplitudes of the said timing signals ($T_1$, $T_2$, $T_3$) on the basis of the level of the said first reaction signal (FBI).

26. Method according to claim 22, characterised in that the said first control mode (HARDWARE) additionally comprises the step of repeating the steps c), d), e) and f) for a predetermined time ($t_{BYPASS}$, $t_{HOLD}$).

27. Method according to claim 22, characterised in that the said step e) comprises the step of:

c) generating a plurality of the said first reaction signals (FBI), one for each control circuit, each of which is correlated to the said first electrical quantity of the relative electroactuator; and in that the said step f) comprises the step of:

d) modifying the amplitudes of the timing signals ($T_1$, $T_2$, $T_3$) for each of the said control circuits on the basis of the relative first reaction signal (FBI).

28. Method according to claim 27, characterised in that the said step h) comprises the steps of:

h1) comparing each of the said first reaction signals (FBI) with a respective second threshold value; and h2) modifying the amplitudes of the timing signals ($T_1$, $T_2$, $T_3$) for each of the said control circuits, if the amplitude of the relative first reaction signal (FBI) has a second predetermined ratio with the relative second threshold value.

29. Method according to claim 28, characterised in that each of the said first reaction signals (FBI) can be switched between a first and a second level; in that the said step h1) comprises the step of:

h11) determining the level of each of the said first reaction signals (FBI); and in that the said step h2) comprises the step of:

h21) modifying the amplitudes of the timing signals ($T_1$, $T_2$, $T_3$) for each of the said control circuits on the basis of the level of the relative first reaction signal (FBI).

30. Method according to claim 27, characterised in that the said first control mode (HARDWARE) additionally comprises the step of repeating the steps c), d), g) and h) for a predetermined time ($T_{BYPASS}$, $t_{HOLD}$).

31. Method according to claim 21, characterised in that the said second control mode (SOFTWARE) comprises the steps of:

e) Generating timing signals ($T_1$, $T_2$, $T_3$) which have respective predetermined timings;

f) Supplying the said timing signals ($T_1$, $T_2$, $T_3$) to the said control circuits in order to control the said electroactuators.

32. Method according to claim 31, characterised in that the said step i) comprises the steps of:

i1) generating timing signals ($T_1$, $T_2$, $T_3$) with predetermined amplitudes;

i2) measuring the time ($t_B$) which has elapsed since generation of the said timing signals ($T_1$, $T_2$, $T_3$) with the said predetermined amplitudes;

i3) comparing the said time which has elapsed ($t_B$) with a third predetermined threshold value ($t_{ONH}$, $t_{ONL}$, $t_P$, $T_1$, $T_2$, $T_3$); and i4) modifying the amplitudes of the said timing signals ($T_1$, $T_2$, $T_3$) if the said time ($t_B$) which has elapsed has a third predetermined ratio with the said third threshold value ($t_{ONH}$, $t_{ONL}$, $t_P$, $T_1$, $T_2$, $T_3$).

33. Method according to claim 32, characterised in that the said third predetermined ratio is defined by the condition that the said time ($t_B$) which has elapsed is longer than, or the same as the said third threshold value ($t_{ONH}$, $t_{ONL}$, $t_P$, $T_1$, $T_2$, $T_3$).

34. Method according to claim 32, characterised in that the said step i) additionally comprises the step of repeating the steps from i1) to i4) for a predetermined time ($t_{BYPASS}$, $t_{HOLD}$).

35. Method according to claim 21, characterised in that the said first and second control modes (HARDWARE, SOFTWARE) additionally comprise the steps of:

n) generating the said timing signals ($T_1$, $T_2$, $T_3$);

p) generating a plurality of second reaction signals (FBV1), one for each control circuit, each correlated to a respective second electrical quantity of the said piloting means;

q) carrying out operations of diagnostics of the said piloting means and of the said electroactuators according to the said second reaction signals (FBV1).

36. Method according to claim 35, characterised in that each of the said second electrical quantities comprises the voltage of a respective first output terminal of the said piloting means.

37. Method according to claim 35, characterised in that the said step q) comprises the steps of:

q1) comparing the said second reaction signals (FBV1) with first reference reaction signals which indicate correct functioning of the said piloting means and of the said electroactuators; and q2) determining a condition of malfunctioning of the said piloting means and of the said electroactuators, if the said second reaction signals (FBV1) have a fifth predetermined operative ratio with the said first reference reaction signals.

38. Method according to claim 35, characterised in that the said first and second control modes (HARDWARE, SOFTWARE) additionally comprise the steps of:

r) generating a plurality of third reaction signals (FBV2), one for each control circuit, each correlated to a respective third electrical quantity of the said piloting means;

s) carrying out the said operations of diagnostics of the said piloting means and of the said electroactuators, according to the said second and third reaction signals (FBV1).

39. Method according to claim 38, characterised in that each of the said third electrical quantities comprises the voltage of a respective second output terminal of the said piloting means.

40. Method according to claim 38, characterised in that the said step q) additionally comprises the steps of:

q3) comparing the said third reaction signals (FBV1) with second reference reaction signals which indicate correct functioning of the said piloting means and of the said electroactuators; and q4) determining a condition of malfunctioning of the said piloting means and of the said electroactuators if the said second reaction signals (FBV1) have a sixth predetermined operative ratio with the said second reference reaction signals.

41. Control device for electroactuators comprising:

piloting means for the said electroactuators; and timing means which generate timing signals (T) supplied to the said piloting means in order to control the said electroactuators;

the said piloting means having a first and a second input terminal which are connected in use respectively to a first and a second terminal of an electrical energy source, and a plurality of pairs of output terminals, one for each of the said electroactuators; each pair of output terminals comprising a first and second output terminal between which a respective electroactuator is connected in use;

the said piloting means comprising a plurality of control circuits, one for each electroactuator, receiving as input the said timing signals (T), and being activated selectively by the timing signals (T) themselves for control of the respective electroactuators; characterised in that each of the said control circuits comprises:

first controlled switch means which are connected between a respective first output terminal, and, at least in pre-determined operating conditions, the first input terminal of the said piloting means, said first controlled switch means further comprising first transistor means;

second controlled switch means which are connected between a respective second output terminal and the second input terminal of the said piloting means, said second controlled switch means further comprising second transistor means; and third controlled switch means which are connected between the respective first output terminal and the second input terminal of the said piloting means.

42. Device according to claim 41, characterised in that the said first controlled switch means comprise firs transistor means.

43. Device according to claim 42, characterised in that the said first transistor means comprise a first transistor which has a control terminal connected to the said timing means, and receives from the latter a first timing signal ($T_1$), a first terminal which is connected, at least in the said predetermined operating conditions, to the said first input terminal of the said piloting means, and a second terminal which is connected to the said respective first output terminal of the piloting means themselves.

44. Device according to claim 41, characterised in that the said second controlled switch means comprise second transistor means.

45. Device according to claim 44, characterised in that the said second transistor means comprise a second transistor which has a control terminal connected to the said timing means, and receives from the latter a second timing signal ($T_2$), a first terminal which is connected to a respective said second output terminal of the said piloting means, and a second terminal which is connected to the said second input terminal of the piloting means themselves.

46. Device according to claim 41, characterised in that the said third controlled switch means comprise a first single-pole switch.

47. Device according to claim 46, characterised in that the said first single-pole switch element comprises a first diode which has a cathode terminal connected to the said first output terminal of the said piloting means, and an anode terminal which is connected to the said second input terminal of the said piloting means themselves.

48. Device according to claim 43, characterised in that the said piloting means additionally comprise voltage increasing means which are connected to the said control circuits in order to supply the said electroactuators.

49. Device according to claim 48, characterised in that the said voltage-increasing means comprise a voltage-increasing circuit which is connected to the said control circuits, and comprises energy accumulation means, voltage-increasing means which are connected between the said first input terminal of the said piloting means and the said energy accumulations means, and fourth controlled switch means which are connected between the said energy accumulations means and the said control circuits, in order to permit selective transfer of energy between the said energy accumulation means and the said electroactuators.

50. Device according to claim 49, characterised in that the said voltage-increasing means comprise a voltage-increasing circuit which has an input terminal connected to the said first input terminal of the said piloting means, and first and second output terminals; and in that the said energy accumulation means comprise a capacitive element which is connected between the said first and second output terminals of the said voltage-increasing circuit.

51. Device according to claim 50, characterised in that the said fourth controlled switch means comprise third transistor means which are connected between the said first output terminal of the said voltage-increasing circuit and the first terminals of the first transistors of the said control circuits; a second single-pole switch which is connected between the said first input terminal of the said piloting means and the first terminals of the first transistors of the said control circuits; and a plurality of third single-pole switches, one for each control circuit, connected between respective second output terminals of the said piloting means and the said first output terminal of the said voltage increasing circuit.

52. Device according to claim 51, characterised in that the said third transistor means comprise a third transistor which has a control terminal connected to the said control means, and receives from the latter a third timing signal ($T_3$), a first terminal connected to the said first output terminal of the said voltage-increasing circuit, and a second terminal connected to the first terminals of the first transistors of the said control circuits.

53. Device according to claim 51, characterised in that the said second single-pole switch comprises a second diode which has an anode terminal connected to the said first input terminal of the said piloting means, and a cathode terminal connected to the first terminals of the first transistors of the said control circuits.

54. Device according to claim 51, characterised in that each of the said third single-pole switches comprises a third diode which has an anode terminal connected to the respective second output terminal of the said piloting means, and a cathode terminal connected to the said first output terminal of the said voltage-increasing circuit.

55. Device according to claim 43, characterised in that the said first, second and third transistors are MOSFET transistors.

56. Device according to claim 48, characterised in that the said voltage-increasing means comprise a plurality of voltage-increasing circuits, each of which is connected to at least a respective one of the said control circuits; each of the said voltage increasing circuits comprising energy accumulation means, voltage-increasing means connected between the said first input terminal of the said piloting means and the said energy accumulation means, and fifth controlled switch means connected between the said energy accumulation means and the corresponding control circuit, in order to permit selective transfer of energy between the said energy accumulation means and the relative electroactuator.

57. Device according to claim 56, characterised in that the said voltage-increasing means comprise a voltage-increasing circuit which has an input terminal connected to the said first input terminal of the said piloting means and a first and second output terminal; and in that the said energy accumulation means comprise a capacitate element which is connected between the said first and second output terminals of the said voltage-increasing circuit.

58. Device according to claim 57, characterised in that the said first controlled switch means comprise fourth transistor means connected between the said first output terminal of the said voltage-increasing circuit and the first terminal of the first transistor of the relative control circuit; a fourth single-pole switch connected between the said first input terminal of the said piloting means and the first terminal of the first transistor of the relative control circuit; and a fifth single-pole switch connected between the respective second output terminal of the said piloting means and the said first output terminal of the said voltage-increasing circuit.

59. Device according to claim 58, characterised in that the said fourth transistor means comprise a fourth transistor which has a control terminal connected to the said control means, and receives from the latter a fourth one of the said timing signals ($T_3$), a first terminal connected to the said first output terminal of the said voltage-increasing circuit and a second terminal connected to the first terminal of the first transistor of the relative control circuit.

60. Device according to claim 58, characterised in that the said fourth single-pole switch comprises a fourth diode which has an anode terminal connected to the said first input terminal of the said piloting means, and a cathode terminal connected to the first terminal of the first transistor of the relative control circuit.

61. Device according to claim 58, characterised in that the said fifth single-pole switch comprises a fifth diode which as an anode terminal connected to the said second output terminals of the said piloting means, and a cathode terminal connected to the said first output terminal of the said voltage increasing circuit.

62. Device according to claim 43, characterised in that the said first, second and fourth transistors are MOSFET transistors.

63. Method for controlling a control device according to claim 41, characterised in that it comprises the steps of:

a) selecting from between a first and second predetermined control mode (HARDWARE, SOFTWARE) of the said control device, an operative control mode (HARDWARE, SOFTWARE) to be implemented; the said first control mode (HARDWARE) making it possible to carry out closed-loop control of the said piloting means, and the said second control means (SOFTWARE) making it possible to carry out open-loop control of the said piloting means; and b) implementing the said operative control mode (HARDWARE, SOFTWARE).

64. Method according to claim 63, characterised in that the said first control mode (HARDWARE) comprises the steps of:

c) generating timing signals ($T_1$, $T_2$, $T_3$) which have first predetermined amplitudes;

d) supplying the said timing signals ($T_1$, $T_2$, $T_3$) to the said control circuits, in order to control the said electroactuators;

e) generating at least one first reaction signal (FBI) which is correlated to a first electrical quantity of the said electroactuators; and f) nodifying the first amplitudes of the said timing signals ($T_1$, $T_2$, $T_3$) according to the said first reaction signal (FBI).

65. Method according to claim 64, characterised in that the said first electrical quantity comprises the current ($I_L$) which flows in the electroactuators.

66. Method according to claim 64, characterised in that the said step f) comprises the steps of:

f1) comparing the amplitude of the said first reaction signal (FBI) with a first threshold value; and f2) modifying the amplitudes of the said timing signals ($T_1$, $T_2$, $T_3$) if the amplitude of the said first reaction signal (FBI) has a first predetermined ratio with the said first threshold value.

67. Method according to claim 66, characterised in that the said first reaction signal (FBI) can be switched between a first and a second level; in that the said step fl) comprises the step of:

f11) determining the level of the said first reaction signal (FBI); and in that the said step f2) comprises the step of:

f21) modifying the amplitudes of the said timing signals ($T_1$, $T_2$, $T_3$) on the basis of the level of the said first reaction signal (FBI).

68. Method according to claim 64, characterised in that the said first control mode (HARDWARE) additionally comprises the step of repeating the steps c), d), e) and f) for a predetermined time ($t_{BYPASS}$, $t_{HOLD}$).

69. Method according to claim 64, characterised in that the said step e) comprises the step of:

g) generating a plurality of the said first reaction signals (FBI), one for each control circuit, each of which is correlated to the said first electrical quantity of the relative electroactuator; and in that the said step 5) comprises the step of:

h) Modifying the amplitudes of the timing signals ($T_1$, $T_2$, $T_3$) for each of the said control circuits on the basis of the relative first reaction signal (FBI).

70. Method according to claim 69, characterised in that the said step h) comprises the steps of:

h1) comparing each of the said first reaction signals (FBI) with a respective second threshold value; and h2) modifying the amplitudes of the timing signals ($T_1$, $T_2$, $T_3$) for each of the said control circuits, if the amplitude of the relative first reaction signal (FBI) has a second predetermined ratio with the relative second threshold value.

71. Method according to claim 70, characterised in that each of the said first reaction signals (FBI) can be switched between a first and a second level; in that the said step h1) comprises the step of:

h11) determining the level of each of the said first reaction signals (FBI); and in that the said step h2) comprises the step of:

h21) modifying the amplitudes of the timing signals ($T_1$, $T_2$, $T_3$) for each of the said control circuits on the basis of the level of the relative first reaction signal (FBI).

72. Method according to claim 69, characterised in that the said first control mode (HARDWARE) additionally comprises the step of repeating the steps c), d), g) and h) for a predetermined time ($t_{BYPASS}$, $t_{HOLD}$).

73. Method according to claim 63, characterised in that the said second control mode (SOFTWARE) comprises the steps of:

i) generating timing signals ($T_1$, $T_2$, $T_3$) which have respective predetermined timings;

m) supplying the said timing signals ($T_1$, $T_2$, $T_3$) to the said control circuits in order to control the said electroactuators.

74. Method according to claim 73, characterised in that the said step i) comprises the steps of:

i1) generating timing signals ($T_1$, $T_2$, $T_3$) with predetermined amplitudes;

i2) measuring the time ($t_B$) which has elapsed since generation of the said timing signals ($T_1$, $T_2$, $T_3$) with the said predetermined amplitudes;

i3) comparing the said time which has elapsed ($t_B$) with a third predetermined threshold value ($t_{ONH}$, $t_{ONL}$, $t_P$, $T_1$, $T_2$, $T_3$); and i4) modifying the amplitudes of the said timing signals ($T_1$, $T_2$, $T_3$) if the said time ($t_B$) which has elapsed has a third predetermined ratio with the said third threshold value ($t_{ONH}$, $t_{ONL}$, $t_P$, $T_1$, $T_2$, $T_3$).

75. Method according to claim 74, characterised in that the said third predetermined ratio is defined by the condition that the said time ($t_B$) which has elapsed is longer than, or the same as the said third threshold value ($t_{ONH}$, $t_{ONL}$, $t_P$, $T_1$, $T_2$, $T_3$).

76. Method according to claim 74, characterised in that the said step i) additionally comprises the step of repeating the steps from i1) to i4) for a predetermined time ($t_{BYPASS}$, $t_{HOLD}$).

77. Method according to claim 65, characterised in that the said first and second control modes (HARDWARE, SOFTWARE) additionally comprise the steps of:

n) generating the said timing signals ($T_1$, $T_2$, $T_3$);

t) generating a plurality of second reaction signals (FBV1), one for each control circuit, each correlated to a respective second electrical quantity of the said piloting means;

u) carrying out operations of diagnostics of the said piloting means and of the said electroactuators according to the said second reaction signals (FBV1).

78. Method according to claim 77, characterised in that each of the said second electrical quantities comprises the voltage of a respective first output terminal of the said piloting means.

79. Method according to claim 77, characterised in that the said step q) comprises the steps of:

q1) comparing the said second reaction signals (FBV1) with first reference reaction signals which indicate correct functioning of the said piloting means and of the said electroactuators; and q2) determining a condition of malfunctioning of the said piloting means and of the said electroactuators, if the said second reaction signals (FBV1) have a fifth predetermined operative ratio with the said first reference reaction signals.

80. Method according to claim 77, characterised in that the said first and second control modes (HARDWARE, SOFTWARE) additionally comprise the steps of:

v) generating a plurality of third reaction signals (FBV2), one for each control circuit, each correlated to a respective third electrical quantity of the said piloting means;

w) carrying out the said operations of diagnostics of the said piloting means and of the said electroactuators, according to the said second and third reaction signals (FBV1).

81. Method according to claim 80, characterised in that each of the said third electrical quantities comprises the voltage of a respective second output terminal of the said piloting means.

82. Method according to claim 80, characterised in that the said step q) additionally comprises the steps of:

q3) comparing the said third reaction signals (FBV1) with second reference reaction signals which indicate correct functioning of the said piloting means and of the said electroactuators; and q4) determining a condition of malfunctioning of the said piloting means and of the said electroactuators if the said second reaction signals (FBV1) have a sixth predetermined operative ratio with the said second reference reaction signals.

* * * * *